US005915148A

United States Patent [19]

Hamaguchi et al.

[11] Patent Number: 5,915,148

[45] Date of Patent: Jun. 22, 1999

[54] NETWORK SYSTEM FOR COPIERS

[75] Inventors: Kazuya Hamaguchi, Nara; Atsushi Narukawa, Yamatokoriyama; Fuminori Miyoshi; Eiji Sato, both of Nara; Hidenori Ohnishi; Tokiyuki Okano, both of Yamatokoriyama, all of Japan

[73] Assignee: Sharp Kabushiki Kaisha, Osaka, Japan

[21] Appl. No.: 09/099,834

[22] Filed: Jun. 18, 1998

[30] Foreign Application Priority Data

Jun. 20, 1997 [JP] Japan ..... 9-163882

[51] Int. Cl.[6] ..... G03G 15/00; G03G 21/00

[52] U.S. Cl. ..... 399/77; 399/8

[58] Field of Search ..... 399/77, 76, 75, 399/88, 90, 8

[56] References Cited

U.S. PATENT DOCUMENTS

| | | | |
|---|---|---|---|
| 5,361,265 | 11/1994 | Weinberger et al. | 355/205 X |
| 5,398,257 | 3/1995 | Groenteman | 355/207 X |
| 5,784,663 | 7/1998 | Hayashi et al. | 399/8 |
| 5,812,874 | 9/1998 | Yamashita et al. | 399/8 X |

OTHER PUBLICATIONS

Japanese Published Examined Patent Application No. Sho 60–499001, "Copying Machine with Timer", Feb. 27, 1981, H. Hiroshi et al.

Japanese Published Unexamined Patent Application No. Hei 9–16032, "Drive Controller", Jan. 17, 1997, Seiji et al.

Japanese Published Unexamined Patent Application No. Hei 7–72768, "Image Forming System", M. Nobuo et al., Mar. 17, 1995.

*Primary Examiner*—Richard Moses

*Attorney, Agent, or Firm*—David G. Conlin; William J. Daley, Jr.

[57] ABSTRACT

A network system for copiers includes a plurality of copiers each provided with a communication device for communicating with external equipment and a power-on device for powering on the copier in a hold state in response to an external signal received by the communication device and a main controller including an operation controller for controlling operation of the copiers and a time setter for setting time to power on a copier, the main controller being connected to the copiers by a network. The operation controller executes control such that only predetermined one of the copiers is powered on at the power-on time set by the time setter.

13 Claims, 29 Drawing Sheets

NETWORK SYSTEM FOR COPIERS

CROSS-REFERENCE TO RELATED APPLICATION

This application is related to Japanese application No. HEI 9(1997)-163882, filed on Jun. 20, 1998 whose priority is claimed under 35 USC §119, the disclosure of which is incorporated by reference in its entirety.

BACKGROUND OF THE INVENTION

1. Field of the Invention

The present invention relates to complex digital copiers having a communication function, more particularly a network system for copiers to control a switch-on operation of a plurality of copiers which are connected with each other 2. Description of Related Art As disclosed by Japanese Patent Publication No. SHO 60(1985)-49901, conventionally known is a copier including a clock circuit, a storage for storing a time to open/close a start-up circuit of the copier, a control circuit controlling the open/close of the start-up circuit when detecting that it becomes the open/close time, and a circuit for maintaining power supply to the copier regardless of the above open/close control, wherein the copier controls the open/close at the set open/close time.

This publication describes means for opening and closing the power supply to the copier by use of an inner counter. With this construction, the copier can reduce power consumption.

However, the conventional power supply open/close device has the following problems. With increasing volume of information, there is a tendency of more and more copiers used in an office, a company or the like. In an increasing number of cases, a plurality of copiers are installed on one floor, or a copier or copiers is/are places on each floor of one company.

Under these circumstances, it needs an enormous amount of time to set the open/close control in every copier. Also, even if the power supply is opened at an hour when copiers are used most frequently, all copiers are rarely used at the same time. That results in a waste of power.

Further, where copiers are powered on at the same time, heater lumps of the copiers may be lighted at the same time. The heater lumps are heat sources for fixing devices of the copiers and consume most of the power required by the copiers. As a result, a breaker of a switch-board may be actuated by a mass of rush currents, or a decline in power source voltage may cause a flicker of fluorescent lumps and mis-operation of electric appliances. These problems will be restricted in the future as is evident from the fact that an item of harmonic test has been established for the CE mark which is an European safety standard. It is also difficult to control all copiers together, for example, by an administration department or the like of a company in view of reduction of power consumption.

Other related arts are as follows: Japanese Unexamined Patent Publication No. HEI 7(1995)-72768 discloses an image producing system in which a plurality of image copiers are connected to each other and the maximum power consumption of the whole system is controlled below a predetermined value by detecting a on or off state of fixation heaters of the image copiers.

Japanese Unexamined Patent Publication No. HEI 9(1997)-16032 discloses a drive control device to reduce power consumption of an electro-photographic device on standby so that the total power consumption of the standby electro-photographic device and an operating electro- photographic device does not exceed a predetermined value.

SUMMARY OF THE INVENTION

The present invention provides a network system for copiers comprising a plurality of copiers each provided with communication means for communicating with external equipment and power-on means for powering on the copier in a hold state in response to an external signal received by the communication means; and a main controller including operation control means for controlling operation of the copiers and time setting means for setting time to power on a copier, the main controller being connected to the copiers by a network, wherein the operation control means executes control such that only predetermined one of the copiers is powered on at the power-on time set by the time setting means.

According to the present invention, since only one copier is powered on at the power-on time, a first user can copy at a time for starting work, while a wasteful power consumption can be avoided, compared with the case where a plurality of copiers are powered on at the same time.

DESCRIPTION OF THE PREFERRED EMBODIMENTS

Figure 1:
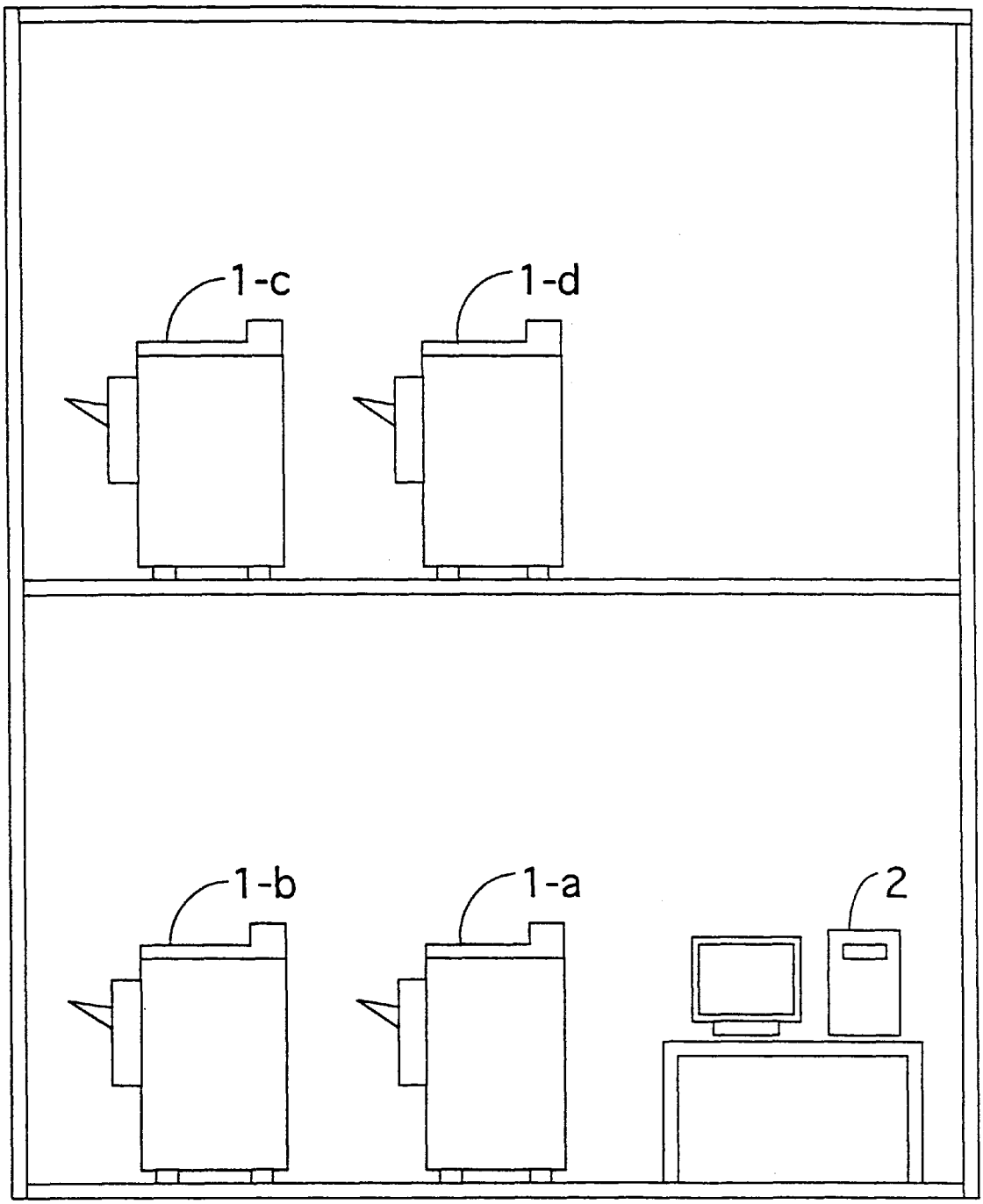
FIG. 1 shows an exemplary arrangement of networked copiers in accordance with one embodiment of the present invention.

The present invention provides a network system for copiers which allows only one of plural copiers placed on the same floor, for example, to be powered on to get ready for copying at a certain time, e.g., immediately after working hours or school hours start thereby to reduce a wasteful power consumption.

The present invention also provides a network system for copiers comprising a plurality of copiers each provided with communication means for communicating with external equipment, power-on means for powering on the copier in a hold state to bring them into a ready-to-copy state in response to an external signal received by the communication means, and signal generating means for generating a ready-to-copy signal indicating that a copier becomes ready to copy; a controller for externally controlling the copiers; and connection means for connecting the copiers and the controller, wherein a copier is powered in response to the ready-to-copy signal from another copier.

With the above-described construction, only one of two digital copiers placed on the same floor is powered on at a predetermined time, e.g., just after the starting time of a company or a school. Then after said copier becomes ready for copying, another copier is switched on to start its warm-up. Thus the warm-up of the two copiers does not occur simultaneously. The warm-up generally consume power most. Therefore, effect of the warm-up on the supply voltage can be minimized. During the warm-up of the secondly powered-on copier, a user can make copies with the copier having powered up first, and therefore, waste of time can be avoided.

The present invention also provides a network system for copiers comprising a plurality of copiers each provided with communication means for communicating with external equipment, power-on means for powering on the copier in a hold state to bring it into a ready-to-copy state in response to an external signal received by the communication means, signal generating means for generating a signal indicating that a heater lump for fixation is on and detection means for detecting supply voltage of the copier; a controller for externally controlling the copiers; a control method for drawing power current during the heater lump is on into the controller by the detection means; and connection means for connecting the copiers and the controller, wherein, after the end of peak current of a copier, another copier is powered on.

With this construction, the effect on the supply voltage can be minimized and also waiting time of a user of a second copier can be reduced. The reason is that the maximum current of a copier is present mainly for a short time after power-on, and that in the abovedescribed invention, the maximum currents of the copiers are timed not to coincide with each other.

The present invention also provides a network system for copiers comprising a plurality of copiers each provided with communication means for communicating with external equipment, detection means for detecting the temperature of a fixing section, control means for keeping the temperature of the fixing section constant, and signal generating means for generating a notice signal noticing the lighting of a heater lump of the copier and a prohibition signal for prohibiting the lighting of the heater lump in response to an external signal; a controller for externally controlling the copiers having the above-mentioned means; and connection means for connecting the copiers and the controller, wherein, when one copier sends the notice signal, the lighting of the heater lumps of the other copiers is prohibited.

Generally, a halogen lump is often used as the heater lump. At the moment the halogen lump lights, a rush current flows for a very short period of time. This rush current is about ten times as strong as a normal current. The heater lumps repeats ONs and OFFs in the ready-to-copy state or during copying operation, in order to maintain the temperature of the fixing section constantly. If the lighting occurs at the same time in plural adjacent copiers, the supply voltage is adversely influenced to no small extent, though this adverse influence affection is not as large as that immediately after the copiers are powered on.

For maintaining the temperature of the fixing section, a temperature detector (thermistor) is usually used. When the temperature detected by the thermistor reaches a predetermined temperature, the heater lump is on. With the above-described construction, by sending the notice signal indicating that the heater lump is going to light before it reaches the predetermined temperature, the lighting of the heater lump can be noticed and other copiers can be prevented from lighting. As a result, a number of copiers can be prevented from lighting at the same time.

The invention provides a network system for copiers comprising a plurality of copiers each provided with communication means for communicating with external equipment and power-on means for powering on the copier in a hold state in response to an external signal received by the communication means; and a main controller including operation control means for controlling operation of the copiers and time setting means for setting time to power on a copier, the main controller being connected to the copiers by a network, wherein the operation control means executes control such that only predetermined one of the copiers is powered on at the power-on time set by the time setting means.

With this construction, in the case where a plurality of copiers are placed in one floor of a company or a school, for example, only one of the copies can be powered on to be ready for copying at a pre-set hour, i.e., at a starting hour. In practice, it is very rare for a number of users to rush to the copiers just after the starting hour. The copiers may be used more and more frequently as business or school hours pass.

According to this invention, since one copier is powered on, a first user can make copies at the starting hour, while a wasteful power consumption can be reduced, compared with a case where a plurality of copiers are powered on at the same time.

The present invention also provides a network system for copiers wherein each of the copiers is further provided with signal generating means for generating and sending out a copy-start signal representing that a copying operation starts and a copy-stop signal representing that the copying operation stops, the main controller further includes computation means for computing an average operating time per day for each of the copiers on the basis of the copy-start and copy-stop signals sent from each of the copiers, and the operation control means executes control such that one of the copiers whose average operating time is the shortest or the longest is powered on first.

In the case where a plurality of copiers of different kinds are placed in one floor of a company or a school, for example, the copiers are used with different frequencies. As a result, one or some of the copiers may deteriorate earlier than others and the life thereof may be shorter. With the above-described construction, however, a copier having been used the least frequently can be switched on first by checking the average use time. Consequently, the life of the plural copiers can be uniformed.

In contrast, in the case where a plurality of copiers are placed in one floor of a company or a school, for example, one of the copiers may be used more often than others because the copier is fit and convenient for use. In such a case, if another copier is started up first, the copier suitable for use must be powered on again. With the above-described construction, the copier fit for use can be used without waiting time.

Further, the present invention provides a network system for copiers wherein the main controller further includes a memory for storing power consumption of each of the copiers beforehand, and the operation control means executes control such that one of the copiers whose power consumption is the smallest is powered on.

With this construction, by powering on the copier whose power consumption is the lowest first at the starting hour, power consumed during a standby period until the first user access the copier can be reduced in the case where a plurality of copiers of different kinds are placed in one floor of a company or a school, for example.

Further, in the network system of the present invention, the copiers may further comprise signal generation means for generating a signal indicating occurrence of a trouble, and when a trouble occurs in one of the copiers, other copier may be powered on.

Some troubles which possibly occur with a copier disable the copier for continuing copying operation, e.g., cut of a charge wire. Some troubles cannot be solved by users. Some troubles need much time for finding out the cause thereof. Consequently, there may be delay in making copies. If such a trouble that disables the continuation of copying operation occurs during use of the first copier, for example, the waiting time of a user can be reduced to a minimum by powering on another copier upon the occurrence of the trouble. After the completion of required copies, the user can make contact with a service technician or the like.

Further, in the case where a copy mode employed with the copier having the trouble is available with another copier in the network, said another copier may be powered on.

For example, when the trouble occurs with one copier, if another copier which cannot provide the employed copy mode or required special sheets is powered on, the copying operation cannot be continued. However, if another copier in which the same copy mode can be designated is powered on, there is no problem.

Still further, the copiers of the network system of the present invention may comprise signal generation means for generating and sending out a signal indicating a copy mode. Thereby copy mode of the copier having the trouble is established in another copier.

With this construction, when a trouble occurs with a copier in use, the copying operation can be continued with another copier which can provide the same copy mode only by the user placing a document and actuating a start button without paying attention to the copy mode.

Still further, the number of copies to be made may be set in said another copier after reducing the number of copies already made by the copier in trouble.

With this construction, since said another copier is able to resume the copying operation after the deduction of the number of already completed copies, the completed copies are not needlessly duplicated.

Further, the present invention provides a network system for copiers wherein each of the copiers is further provided with signal generating means for generating and sending out a copy-start signal representing that a copying operation starts, and when the main controller receives the copy-start signal from one of the copiers, the operation control means executes control such that predetermined one of the copiers different from the copier having sent the copy-start signal is powered on.

In the case where only one copier is started up at the starting hour of a company or a school, a second user may wish to use the copier while a first user is still making copies. In such a case, the second user must wait for the first user to finish the copying operation or must turn on another copier. That sometimes wastes about several minutes. With the above-described construction, however, at the moment the first user stars copying, another copier is powered on. Accordingly, the waiting time of the second user can be minimized.

Further, the present invention provides a network system for copiers wherein the main controller further includes a memory for storing a power consumption of each of the connected copiers beforehand, and the operation control means executes control such that the copiers are powered on in ascending order of the power consumptions stored in the memory.

With this construction, consumed power can be reduced where a plurality of copiers are started up.

Further, the present invention provides a network system for copiers wherein the main controller further includes a memory for storing beforehand a warm-up time for each of the copiers to become ready for copying, and the operation control means executes control such that the copiers are powered on in ascending order of the warm-up times stored in the memory.

With this construction, the waiting time can be reduced where a plurality of copiers are used, and therefore efficiency of copying can be improved.

Further, the present invention provides a network system according to claim 4 wherein the main controller further includes a memory for storing a location of each of the copiers beforehand, and the operation control means executes control such that one of the copiers whose location is the nearest to the copier having sent the copy-start signal is powered on.

There are cases where a plurality of copiers are placed in different places on different floors. In such cases, if the second copier powered on when the first user starts making copies is located on a different floor or far from the first copier, it may take some time for a user to reach the place of the second copier. However, with the above-described construction, labor of the user can be saved to a minimum and a user-friendly working environment can be obtained.

Further, the present invention provides a network system for copiers wherein each of the copiers is further provided with scanning means for only scanning a document while the copier is not ready for copying yet after being powered on, and the operation control means executes control such that an image obtained by scanning is transferred to one of the copiers which has sent the copy-start signal.

When a user is going to make copies using a copier under warm-up, the user must wait until the warm-up is completed, e.g., for several minutes. With this construction, if a copier ready to copy is near the copier under warm-up, an original is read by the copier under warm-up and an output can be produced by the near copier. Thus the user's waiting time is reduced to a minimum.

Further, when a copier is short of a number of sheets required by a copy mode desired by a user, another copier may be powered on.

Further, the present invention provides a network system for copiers wherein the communication means of the copiers send information about a copy mode set by a user to the main controller, the main controller is further provided with a memory for storing a warm-up time for each of the copiers to become ready for copying after being powered on and prediction means for predicting, from the copy mode information sent by one of the copiers, a copying time of said copier, and the operation control means executes control such that other one of the copiers whose warm-up time is shorter than the predicted copying time is powered on.

In the case where, after a first copier is started up, a second copier is powered on when a user starts using the first copier, if a second user starts using the copier only after a considerable time or if the first user makes only a few copies, power is unnecessarily consumed or the copying by the first user is completed earlier than the warm-up of the second copier is completed. With the above-described construction, since the predicted copying time is compared with the warm-up time of copiers and the power-on of copiers is controlled, wasteful power consumption can be saved and at the same time, the waiting time of a next user can be reduced to a minimum.

Further, in the case where a large number of copies are to be produced, if another copier is powered on and the warm-up of said another copier is completed, the copies may also be made by said another copier without a break.

With the above-described construction, if the predicted copying time with the first copier is longer than the warm-up time of another copier, said another copier is powered on. At the time when the second copier becomes ready to copy, if no user starts to use this second copier, a great number of copies which are being made by the first user can be completed in a shorter time by sending image data of an original of the first user to said another copier.

Further, the present invention provides a network system for copiers comprising a plurality of copiers each provided with communication means for communicating with external equipment and power-on means for powering on the copier in a hold state in response to an external signal received by the communication means, and a main controller including an operation control means for controlling operation of the copiers, time setting means for setting a time to power on a copier and a memory for storing a warm-up time for each of the copiers to become ready for copying after being powered on, the main controller being connected to the copiers by a network, wherein the operation control means controls the order and time to power on the copiers so that all the copiers complete warm-up at the set power-on time.

Here, the copiers may be powered on in decreasing order of the warm-up times, for example.

In the case of an office or a company such as a copy center whose business is involved with production of an enormous number of copies by means of a plurality of copiers, even if all the copiers are powered on at the starting hour, the copiers become ready to copy in different time periods depending on characteristics of the copiers. By powering on the copiers in the decreasing order of the warm-up times so that all the copiers becomes ready to copy at a designated time, copying can be simultaneously started with all the copiers at the starting hour. That also contributes to power saving.

Further, the present invention provides a network system for copiers comprising a plurality of copiers each provided with communication means for communicating with external equipment, power-on means for powering on the copier in a hold state in response to an external signal received by the communication means and input means for inputting user identifying information; and a main controller including operation control means for controlling operation of the copiers and an information memory for storing beforehand the user identifying information in correspondence with the kind or the number of copiers that each user is able to use, the main controller being connected to the copiers via a network, wherein the communication means transfers the user identifying information inputted by the input means to the main controller, and the operation control means selects a copier to be powered on on the basis of the transferred user identifying information.

The volume of copies to be made, the quality of copies and the like may vary depending on what kind of copies a user is to make. For example, a person in charge of making copies may need a plurality of copiers when making a large number of copies. A designer may need a copier of high quality, e.g., a copier capable of producing colored copies. With the above-described construction, since a copier suitable for a user's need is powered on, expensive consumable goods are not consumed in a large quantity. That contributes to cost cutting.

EXAMPLES

The present invention is now explained in detail by way of example with reference to the accompanying drawings. FIG. 1 shows an exemplary arrangement of networked image producing apparatus such as copiers in accordance with one embodiment of the present invention.

In the network system for copiers, a plurality of copiers may be located on different floors. For example, digital copiers 1-*a* and 1-*b* are placed on the first floor and digital copiers 1-*c* and 1-*d* are placed on the second floor, as shown in FIG. 1. A controller 2 (e.g., a personal computer or PC for short) is also placed for communication with these digital copiers and for control thereof. The number of copiers are not particularly limited. More copiers may be installed in a large office and less copiers may be installed in a small office.

Figure 2:
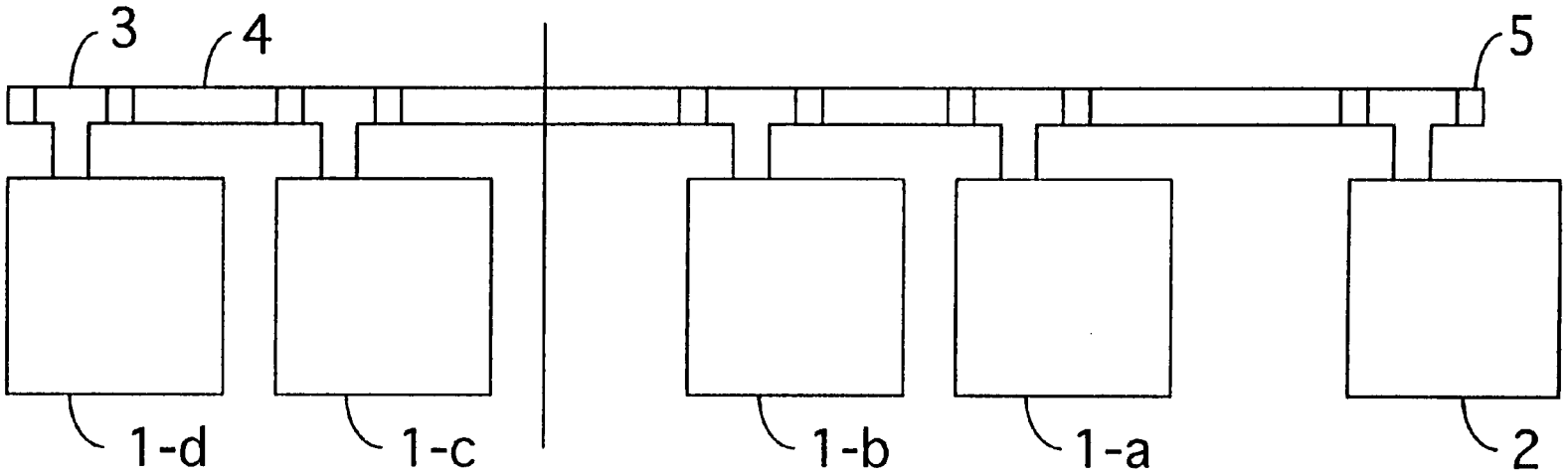
FIG. 2 is a diagram illustrating a connection of networked copiers in accordance with one embodiment of the present invention.
Figure 3:
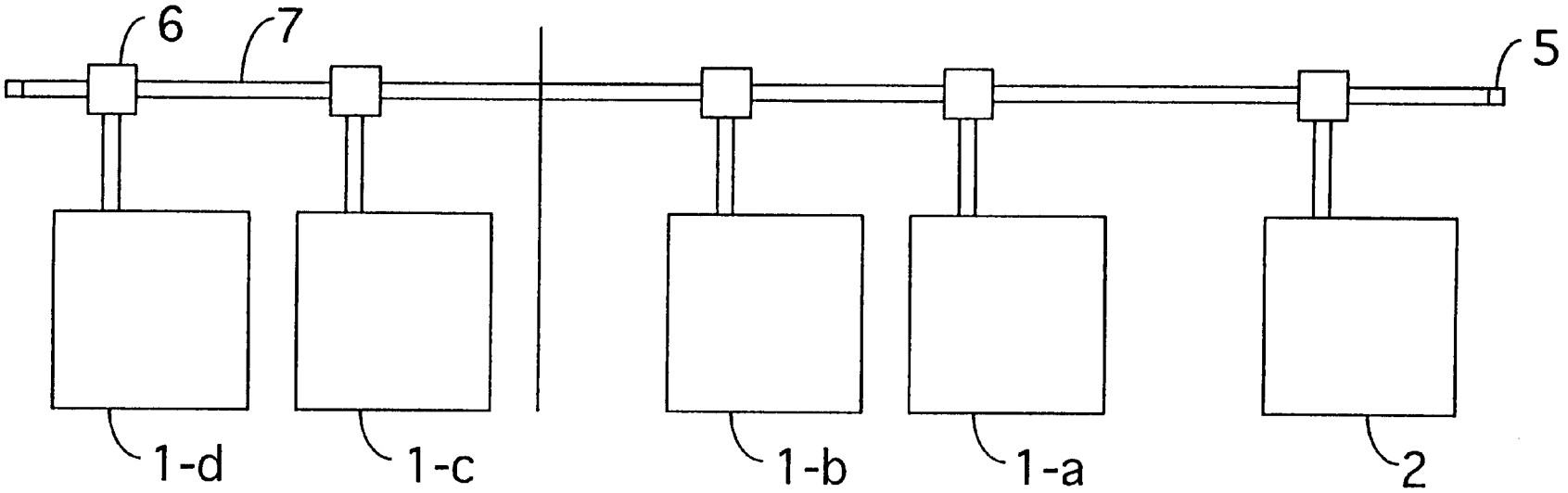
FIG. 3 is a diagram illustrating a connection of networked copiers in accordance with one embodiment of the present invention.
Figure 4:
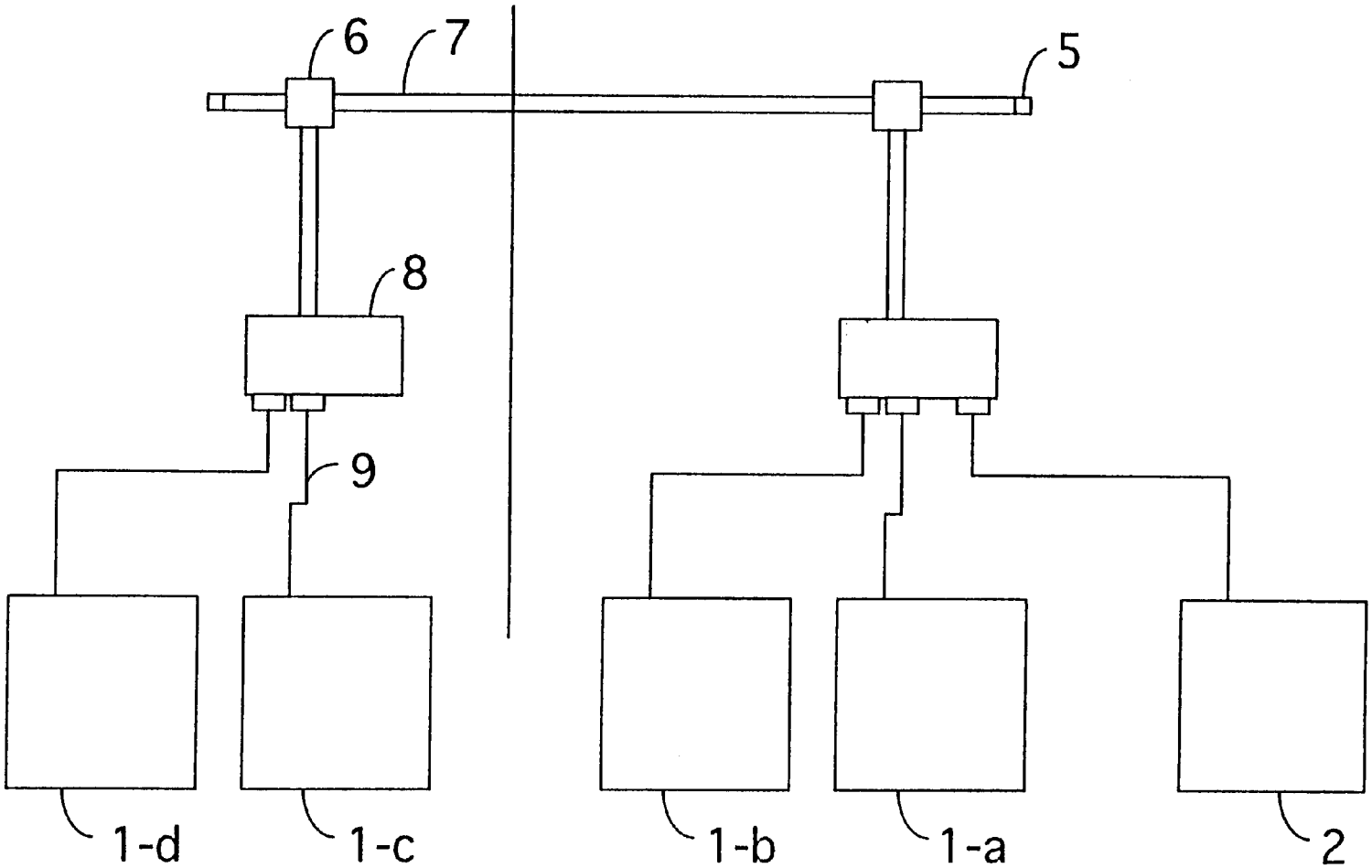
FIG. 4 is a diagram illustrating a connection of networked copiers in accordance with one embodiment of the present invention.

FIGS. 2 to 4 are diagrams illustrating connections of these networked copiers. FIG. 2 shows a connection using a standard 10Base-2. In this connection, LAN cards, not shown, are inserted in the digital copiers 1-*a* to 1-*d* and the PC 2. T-connectors 3 extending from the LAN cards are connected with a cable 4 of the 10Base-2. Terminating resistences 5 are attached to the T-connectors of copiers at both ends of the connection.

That is to say, a feature of the 10Base-2 is that connectors generally referred to as BNC connectors extend in the shape of T from the LAN cards (or LAN boards) inserted into apparatuses and that the apparatuses are connected by connecting a coaxial cable between the connectors of the apparatuses. The terminating resistances (terminators) are mounted to apparatuses situated at both ends. A set defined by the terminators at both ends is called a "segment." One segment can include 30 apparatuses and a cable of 188 m length at maximum.

FIG. 3 shows a connection using a 10Base-5. In this connection, LAN cards, not shown, are inserted in the digital copiers 1-*a* to 1-*d* and the PC 2. The digital copiers and PC 2 are connected to transceivers 6 which are connected to a cable 7 of the 10Base-5.

In other words, a feature of the connection using the 10Base-5 is that the LAN cards are connected to the transceivers which are signal converters via a transceiver cable and that the transceivers are connected to each other via a coaxial cable, as if the apparatuses hung down from the cable. Terminating resistances are required at both ends of the cable. The cable can be extended up to 500 m.

FIG. 4 shows a connection using the 10Base-5 and a 10Base-T. Unlike the connection shown in FIG. 3, the transceiver 6 is connected to an HUB (a line concentrator) 8, which is connected to a cable 9 of the 10Base-T.

The connection using the 10Base-T uses a cable called a 8-wire twisted pair cable having at its end a connector of a shape like a module jack of the telephone cable. LAN cards are connected to the HUB 8 by the twisted pair cable. A characteristic of this connection is that a plurality of apparatus can be connected to one HUB. The distance between an apparatus (LAN card) and the HUB can be up to 100m, the HUBs can be connected to each other, and up to 1,024 apparatuses can be connected.

The HUB is a general name of line concentrators and is used for connection of the 10Base-T or a 100Base-TX. In practice, the HUB is often used for connection in a combination of the 10Base-T and the 10Base-5. This is because the 10Base-5 is suitable for a main line while the 10Base-T is suitable for branching out to a number of apparatuses. The HUB is utilized to provide a connection proper for a purpose. The HUB enables the creation of an efficient network at low cost.

As to the 100Base-TX, which is a high-speed version of the 10Base-T, the connection is basically the same except that a special HUB 8 needs to be used. The 10Base-T can transfer 10 Mbits per second (10 Mbps), while its high-speed version, the 100Base-TX, can transfer 100 M bits per second (100 Mbps). The connection using the 100Base-TX is the same as that using the 10Base-T, but a cable of greater reliability and a special LAN card are required since the data transfer speed is extremely high.

One LAN card is necessary for one apparatus which uses a signal transfer system called Ethernet. The LAN card is connected to an apparatus via a connector compliant with the ISA standard or the PCI standard and to a network via a connector determined by the 10Base-T, -2 or -5. The Ethernet is a network technology developed by Xerox Corporation, US, and is standardized by the IEEE and the ISO.

These apparatuses and devices are connected by a method generally used with PCs, and therefore, detailed explanation about the connection is omitted.

According to the present invention, copiers are not used by themselves. On the contrary, copiers having the LAN card are installed in a general-purpose LAN network. Advantage from using the general-purpose network is that a network exclusive to the copiers need not be created and an existing network can be used.

The digital image producing apparatus of the present invention is, for example, a digital copier which comprises a scanner section, an image processor and an image memory and is also provided with an external communication device (interface means, i.e., the LAN card).

Figure 5:
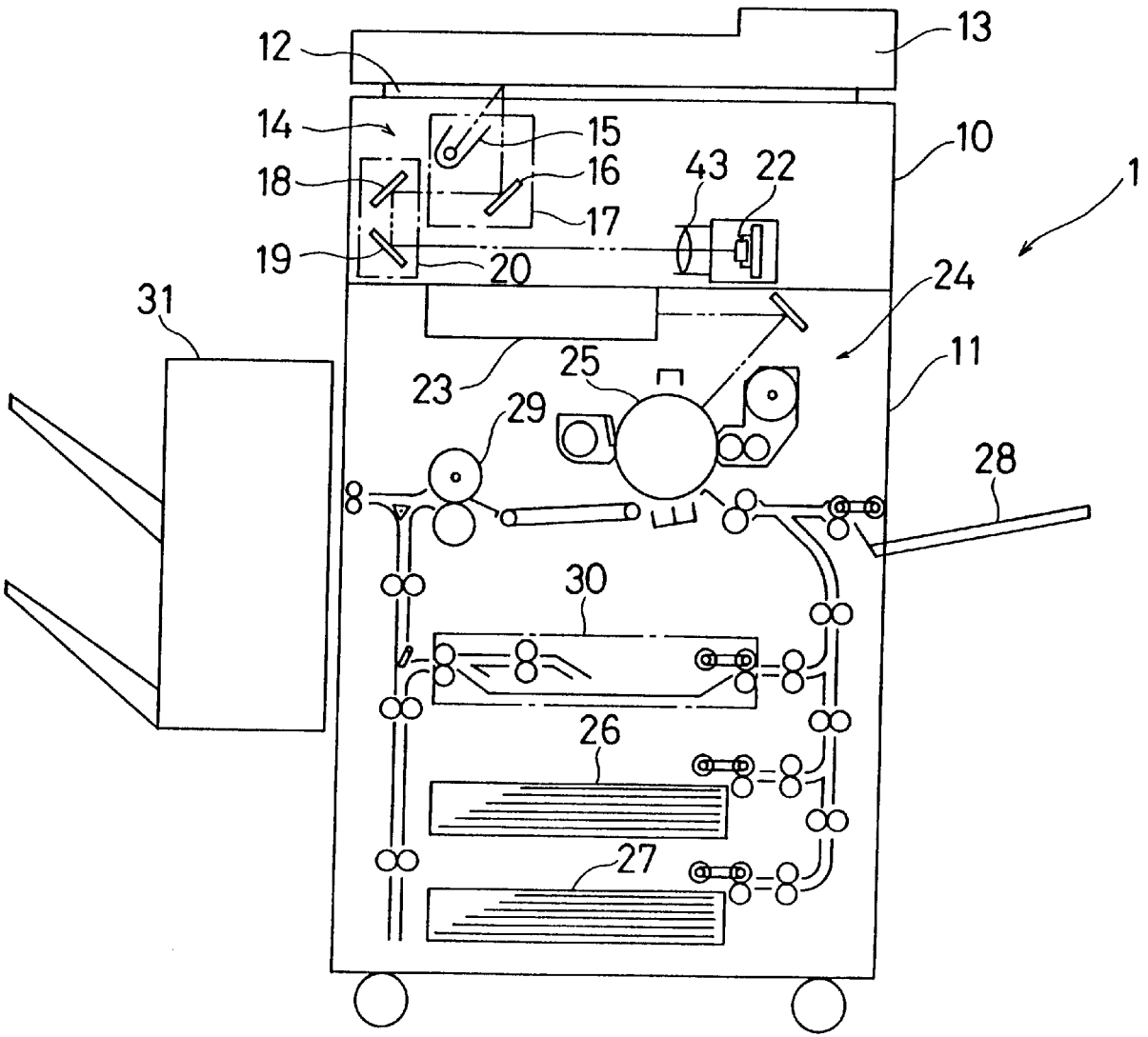
FIG. 5 is a schematic view illustrating a digital image producing apparatus in accordance with one embodiment of the present invention.

First, referring to FIG. 5, the digital image producing apparatus is explained. The digital image producing apparatus here is a digital copier 1 which is mainly comprised of a scanner section 10 and a laser printer section 11.

The scanner section 10 includes a document platen 12 of transparent glass, an automatic document feeder (RADF) 13 for automatically feeding an original document onto the document platen 12 which is ready for double-sided documents, and a document image reading unit, i.e., scanner unit 14, for scanning the document placed on the document platen 12 to read an image on the document. The document image read by the scanner section 10 is sent as image data to an image data input section which is described later, and the image data is subjected to image processing.

The above-mentioned RADF 13 is a device to feed a plurality of documents set on a document tray, not shown, one by one automatically onto the document platen of the scanner unit. The RADF 13 is composed of a transfer path for single-sided documents, a transfer path for double-sided documents, transfer-path switching means, sensors for keeping track of the state of a document passing through a number of sites and a controller, in order that one side or both sides of a document is/are read by the scanner unit on the basis of an instruction of an operator. As regards the RADF 13, a number of patent applications and commercialized articles have conventionally been made, and therefore, more detailed explanation is omitted here.

The scanner unit 14 composing the scanner section for reading an image on a document on the document platen 12 includes a lamp reflector assembly 15 for exposing the document to light, a first scanning unit 17 equipped with a first reflection mirror 16 for reflecting light reflected from the document so as to direct a light image reflected from the document toward a photoelectric converter (CCD), a second scanning unit 20 equipped with a second and a third reflection mirror 18, 19 for directing the light image reflected from the first reflection mirror 16 toward the CCD, an optical lens 21 for imaging the light image reflected from the document via the above-mentioned reflection mirrors on the CCD, and the CCD 22 for converting the reflected light image from the document to electric signals.

The scanning section 10 is so constructed to, by associated actions of the RADF 13 and the scanner unit 14, place documents to be read one by one onto the document platen 12 and read images of the documents with moving the scanner unit 14 along the lower surface of the document platen 12. Particularly, the first scanning unit 17 is moved from left to right in the figure along the document platen at a constant velocity V, and the second scanning unit 20 is controlled to move in the same direction as and in parallel to the move of the first scanning unit 17 at a velocity of V/2 with respect to that of the first scanning unit. Thus, the image of the document placed on the document platen 12 is imaged on the CCD 22 line by line for reading.

The image data obtained by reading the document image by the scanner unit 14 is then transferred to the image processor which is explained later, subjected to various steps of processing, and stored in a memory in the image processor. In response to an output instruction, the image data is read out of the memory and sent to the laser printer section 11 to produce the image on a record sheet. The laser printer section 11 includes a transfer system for feeding record sheets on which images are produced, a laser writing unit 23 and an electrophotographic processor for producing images.

The laser writing unit 23 has a semiconductor laser light source for emitting laser light according to the image data that is read by the scanner unit 14 and then read out of the memory or image data transferred from an external device, a polygon mirror for polarizing the laser light by equal angular velocity, an f-θlens for compensating the laser light polarized by equal angular velocity so that it is polarized by equal angular velocity on a photo-conductor drum 25 composing the electro-photographic processor 24. The electro-photographic processor 24 is equipped with an electrofier, a developer, a transfer printer, a releaser, a cleaner and a static eliminator in the periphery of the photo-conductor drum 25.

The sheet transfer system is provided with a transfer section for transferring a sheet P to a transfer printing position in which located is the transfer printer, especially of the electro-photographic processor to perform the above-mentioned image production; cassette paper feeders 26 and 27 for feeding the sheet P to the transfer section or a manual paper feeder 28 for feeding sheets of desired sizes; a fixer for fixing an image, especially a toner image, produced on the sheet P after transfer printing; and a re-feeding path for re-feeding the sheet P after the fixation so that an image is formed again on the back side of the sheet P. Downstream from the fixer, there is a after-processing device 31 for receiving the sheet P on which the image has been formed and subjecting the sheet P to after-processing.

In the laser writing unit 23 and the electrophotographic processor, the image data read out of the image memory is reproduced in the form of a static latent image on the surface of the conductor drum 25 by laser light scanning by the laser writing unit 23 and this static latent image is then visualized into a toner image with a toner, which is then electrostatically transferred onto a sheet fed from one paper feeder of a multi-plate paper feeding unit.

The sheet on which the image is thus produced is sent from the fixer 29 into the after-processing device 31.

EXPLANATION ABOUT CIRCUITRY OF THE IMAGE PROCESSOR

Now explanation is given about the construction and functions of the image processor for the image-processing of image data of read documents in the digital copier 1.

Figure 6:
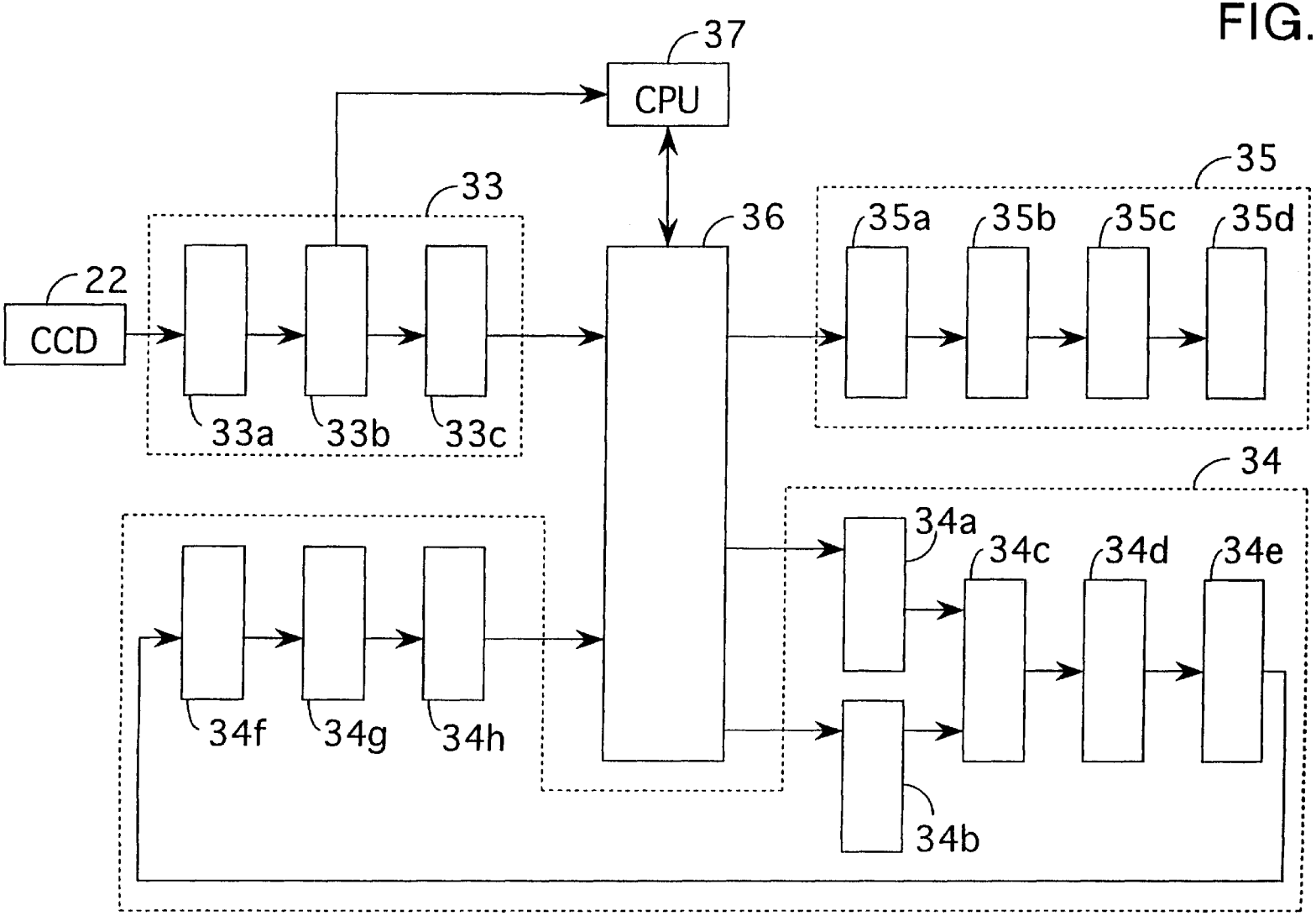
FIG. 6 is a block diagram illustrating an image processor included in a digital image producing apparatus in accordance with one embodiment of the present invention.

FIG. 6 is a block diagram illustrating the construction of the image processor included in the digital copier 1 shown in FIG. 5. The image processor is provided with an image data input section 33, an image processing section 34, an image data output section 35, a memory 36 comprised of a RAM (random access memory), a hard disk and the like, and a central processing unit (CPU) 37.

The image data input section 33 includes a CCD section 33*a,* a histogram processing section 33*b* and an error dispersion processing section 33*c*. The image data input section 33 is constructed so that the image data of a document read by the CCD 22 is converted to binary values, so that a histogram is produced using binary values, so that the image data is processed by an error dispersion method, and so that the processed image data is stored in the memory 36. That is to say, in the CCD section 33*a,* electric analog signals representative of density of pixels of the image data are A/D converted, subjected to an MTF correction, a black-and-white correction or a gamma correction, and outputted as digital signals of 256 levels of gray (eight bits) to the histogram processing section 33*b*.

In the histogram processing section 33*b,* the digital signals outputted by the CCD section 33*a* are integrated by the density of pixels of 256 levels to obtain histogram data. The obtained histogram data is sent to the CPU37 and to the error dispersion processing section 33*c* as pixel data, as necessary.

In the error dispersion processing section 33*c,* the digital signals of eight bits outputted per pixel by the CCD section 33*a* is converted to one-bit signals (to binary values) by the error dispersion processing section, which is a kind of pseudo intermediate processes, that is, by a method of reflecting an error in binary conversion in binary conversion judgment of adjacent pixels. The error dispersion processing section 33*c* performs a re-allotment computation for reproducing local density on the document with fidelity.

The image processing section 34 includes multi-value processing sections 34*a* and 34*b,* a synthesizing section 34*c,* a density change section 34*d,* a magnification change processing section 34*e,* a pixel processing section 34*f,* an error dispersion processing part 34*g* and a compression processing section 34*h*.

The image processing section 34 converts the inputted image data to final image data desired by the operator. The image processing section 34 is so constructed to perform the processing of the image data until the image data is stored in the memory 36. However, the above-mentioned processing sections included in the image processing section 34 may or may not operate, as required.

In the multi-value processing sections 34*a* and 34*b,* the data binarily converted by the error dispersion processing section 33*c* is re-converted to 256 levels of gray. The synthesizing section 34*c* selectively performs a logic computation such as a logical OR, an AND, or an exclusive OR for every pixel. The computation is performed on the image data stored in the memory 36 and bit data from a pattern generator (PG).

In the density change section 34*d,* the relationship between an input density and an output density is arbitrarily set on the basis of a gray level change table with respect to the data signals of 256 levels of gray. The magnification change processing section 34*e* obtains pixel data (density values) for pixels after changing magnification by interpolation with inputted known data in accordance with an instructed magnification. Secondary scanning results are first subjected to magnification change and then main scanning results are subjected thereto.

In the pixel processing section 34*f,* various kinds of image processing are performed on the inputted pixel data and information collection such as feature extraction can be done about a data string. The error dispersion processing part 34*g* performs an operation similar to the one performed by the error dispersion processing section 33*c* of the image data input section 33. The compression processing section 34*h* compresses binary data by a run-length coding. The compression of image data is performed in the last processing loop when the final image data for output is completed.

The image data output section 35 includes a reconstitution section 35*a,* a multi-value processing section 35*b,* an error dispersion processing part 35*c* and a laser output section 35*d.* The image data output section 35 is so constructed to reconstitute the image data stored in the memory in a compressed state, reconvert it to data of the original 256 levels of gray, performing error dispersion of quaternary data which allows smoother halftone display than binary data and send the data to the laser output section 35*d.*

The reconstitution section 35*a* reconstitute the image data compressed by the compression processing section 34*h.* The multi-value processing section 35*b* performs an operation similar to the one performed by the multi-value processing sections 34*a* and 35*b* of the image processing section 34. The error dispersion processing part 35*c* performs an operation similar to the one performed by the error dispersion processing section 33*c* of the image data input section 33.

The laser output section 35*d* converts the digital pixel data to an ON/OFF signal for a laser on the basis of a control signal from sequence control, not shown. Then according to the ON/OFF signal, the semiconductor laser in the laser writing unit 23 is switched to an ON/OFF state, and an electrostatic latent image is written on the conductor drum 25.

In this connection, the data processed by the image data input section 33 and the image data output section 35 is stored in the memory 36 basically in the form of binary data for reducing the capacity of the memory 36. However, in consideration of deterioration of image data, quaternary data may be used.

EXPLANATION ABOUT THE CONTROL OF THE ENTIRE DIGITAL COPIER

Figure 7:
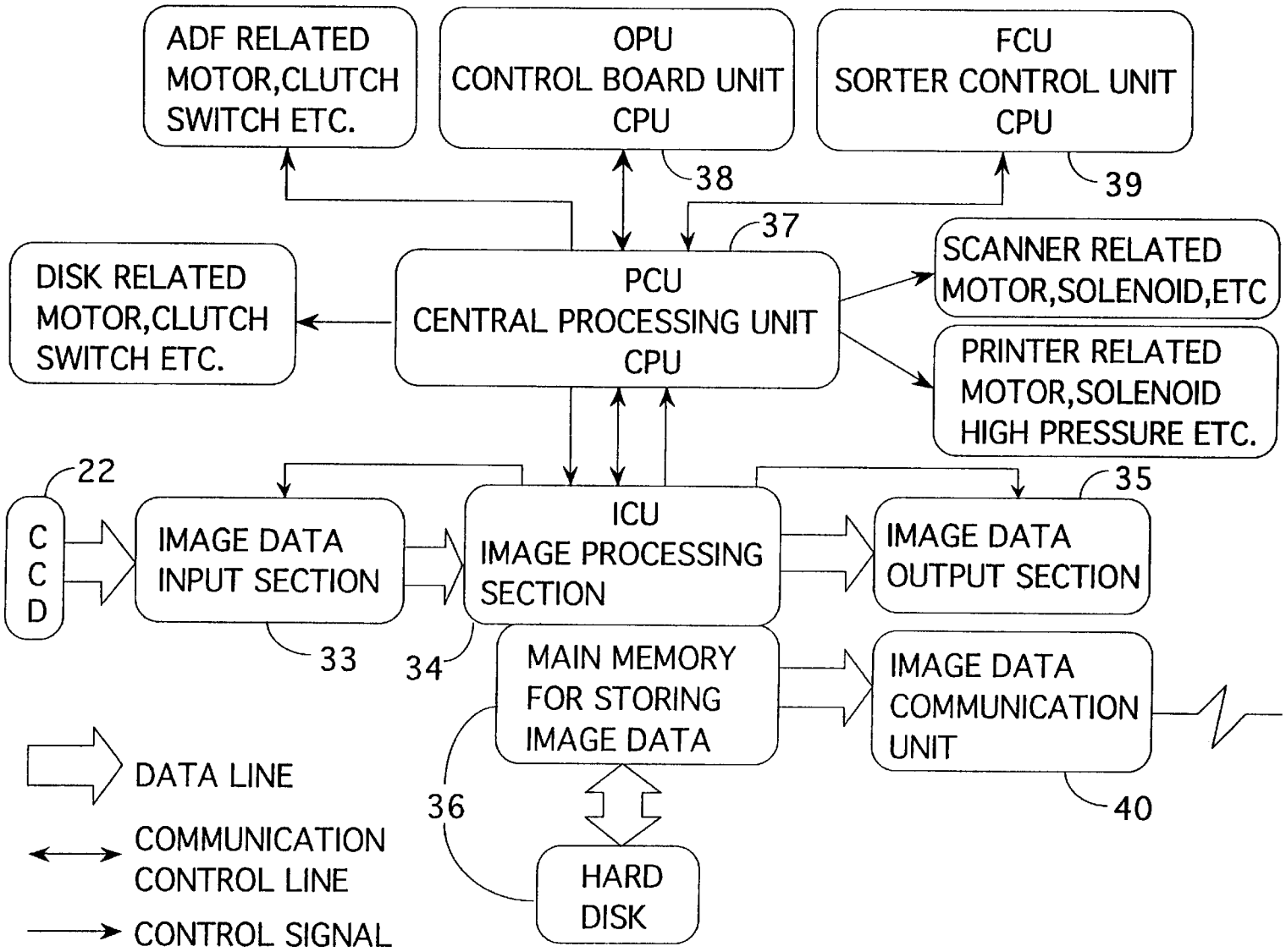
FIG. 7 is a diagram illustrating control of a digital image producing apparatus in accordance with one embodiment of present invention.

FIG. 7 is a diagram illustrating the control of each section of the digital copier 1 by the CPU 37.

The CCD 22, the image data input section 33, the image processing section 34, the image output section 35, the image memory 36 and the CPU 37 are the same as in FIG. 6, and the description thereof is omitted.

The CPU 37 controls drive systems composing the digital copier 1 such as an RADF 13, a scanner section 10 and a laser printer 12 by sequence control as well as outputs control signals to each section.

Further, the CPU 37 is connected to a control board unit 38 comprising a control panel in such a manner that allows mutual communication. The control board unit 38 sends a control signal to the CPU to run the digital copier 1 according to a copy mode inputted by an operator.

The CPU 37 sends a control signal representative of the operating status of the digital copier 1 to the control board unit 38. The control board unit 38 displays the operating status, for example, on a display section on the basis of the control signal to show the current status of the copier to the operator.

In the figure, the reference numeral 39 denotes a sorter control unit 39 which controls the operation of an after-processing device, for example to sort copies outputted by the digital copier 1.

The reference numeral 40 denotes a communication unit for allowing communications of image data, image control signals, control signals for copiers and the like with other digital image apparatus and information-handling devices such as the PC 2. The communication unit is capable of sending images by means of a modem or the like and of bidirectionally transmitting image data, control signals and other signals by means of, for example, a LAN card of the 10Base-2, 10Base-T or 100Base-TX which is used in a network LAN for PCs.

Figure 8:
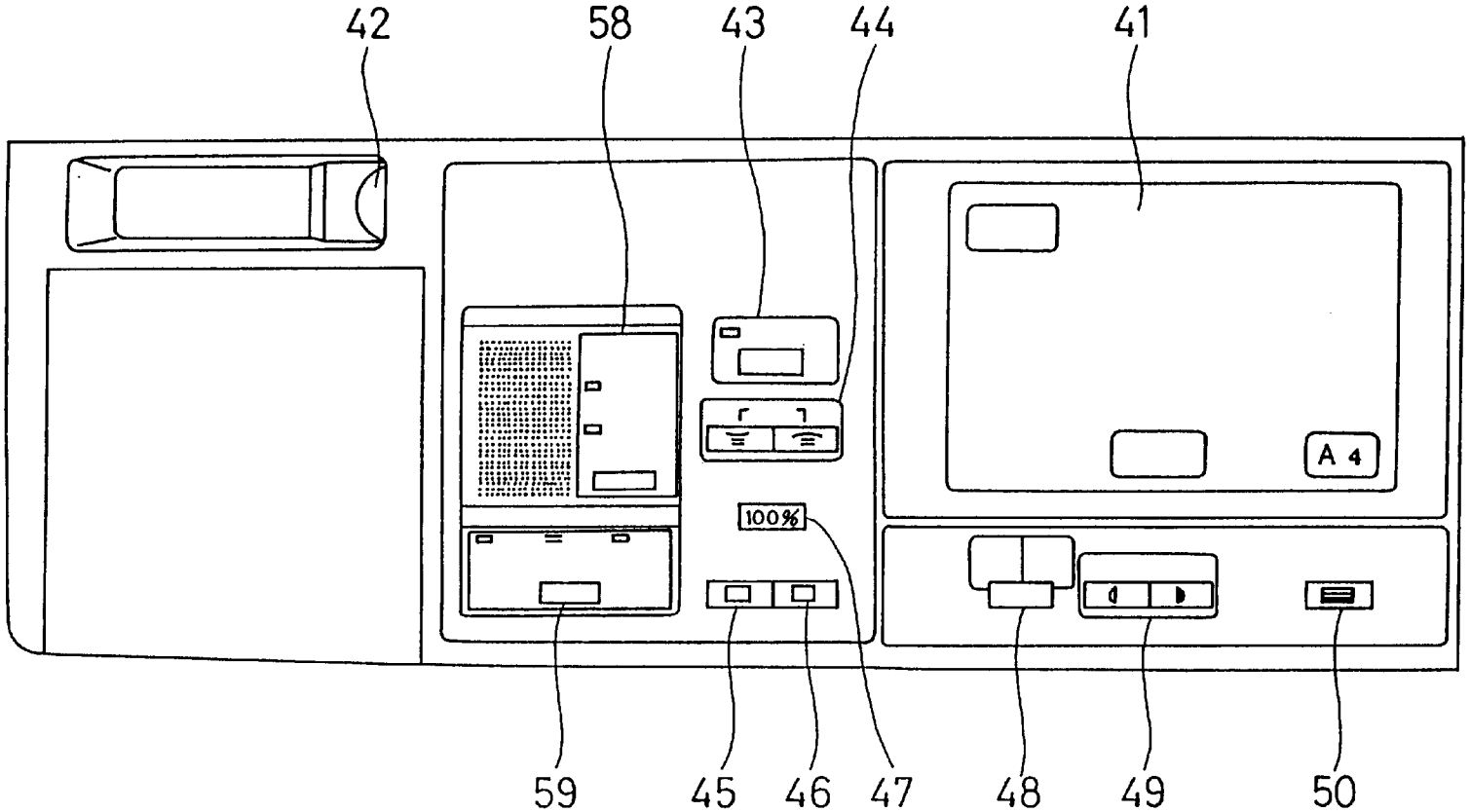
FIG. 8 is a plan view illustrating an exemplary control panel of a digital image producing apparatus in accordance with one embodiment of the present invention.
Figure 9:
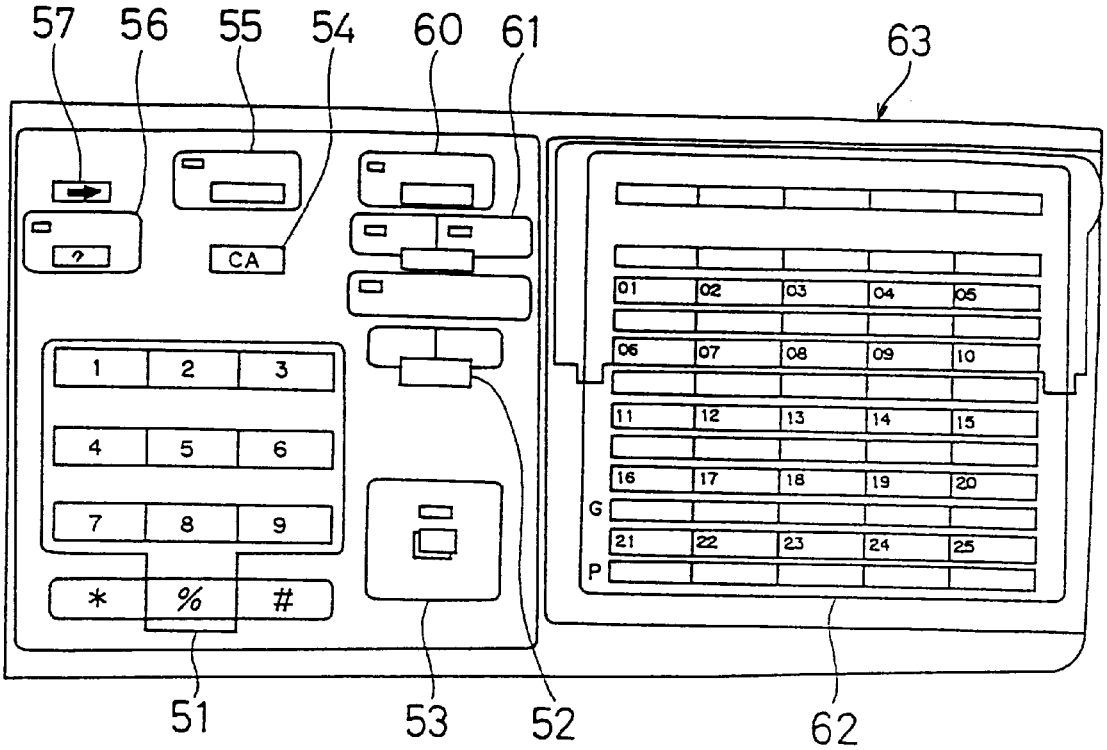
FIG. 9 is a plan view illustrating an exemplary control pan of a digital image producing apparatus in accordance with one embodiment of the present invention.
Figure 9:
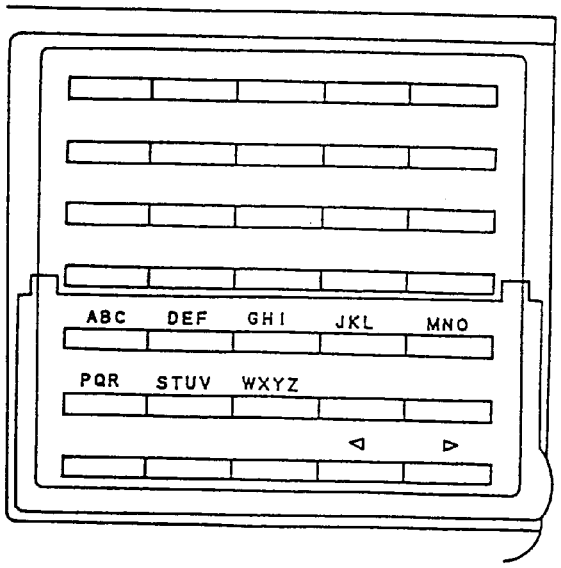

FIGS. 8 and 9 are plan views illustrating an exemplary control panel for the digital copier. FIG. 8 shows a right portion and FIG. 9 shows a left portion of the control panel.

In the central portion of the control panel, there is disposed a tough panel display 41 of liquid crystal, around which a number of mode selection keys are arranged.

On a screen of the touch-panel liquid crystal display 41, there always exists a screen-switching instruction area for instructing switching to a screen for selecting an image editing function. When the operator touches the area, a number of image editing functions are displayed on the liquid crystal display to be selected.

The operator can select one of the displayed manipulation functions by touching by the finger an area in which the desired function is displayed.

Brief description is now given about various setting keys arranged on the control panel 63. The reference numeral 42 denotes a dial for changing the brightness of the screen of the liquid crystal display 41.

The reference numeral 43 denotes an automatic magnification setting key for selecting an automatic magnification selecting mode, 44 denotes a zoom key for setting the copying magnification by 1%, 45 and 46 denote fixed magnification keys for reading out and selecting a fixed magnification, and 47 denotes an equal magnification key for returning the copying magnification to a standard (equal magnification).

The reference numeral 48 denotes a density switch key for switching a copy density to an automatic, a manual or a photograph mode, 49 denotes a density adjusting key for setting a density level strictly in the manual or photograph mode, 50 denotes a tray selection key for selecting one of paper feeding trays containing sheets of different sizes.

The reference numeral 51 denotes a copy quantity key for setting the number of copies to make, 52 denotes a clear key for clearing the setting of the copy quantity or stopping a continuous copying, 54 denotes an all clear key for clearing all modes set currently to return the copier to a standard status, 55 denotes an interrupt key for interrupting a continuous copying to make a copy of another document, 56 denotes an operational guide key for displaying how to operate the copier as a massage when the operator is at a loss what to do with the copier, 57 denotes a massage advance key for instructing the display of a next massage when the operational guide key 56 is actuated, 58 denotes a two-sided copy mode key for setting a two-sided copy mode, and 59 denotes an after-processing mode key for setting a mode of an after-processing device, for example, for sorting copies outputted from the copier.

The reference numerals 60 to 62 denote setting keys relating to printer modes and facsimile modes, 60 denoting a memory transfer mode key for storing an original to be sent in a memory and then sending it, 61 denoting a copy/facsimile/printer mode switch key for switching the digital copier among a copy, facsimile and printer mode, 62 denoting one-touch dialing keys for telephoning one of pre-stored telephone numbers by one single key touch.

The above-described control panel and keys arranged thereon are only an example. It is needless to say that the configuration of keys provided on the control panel may be varied depending on functions of digital copiers.

Figure 10:
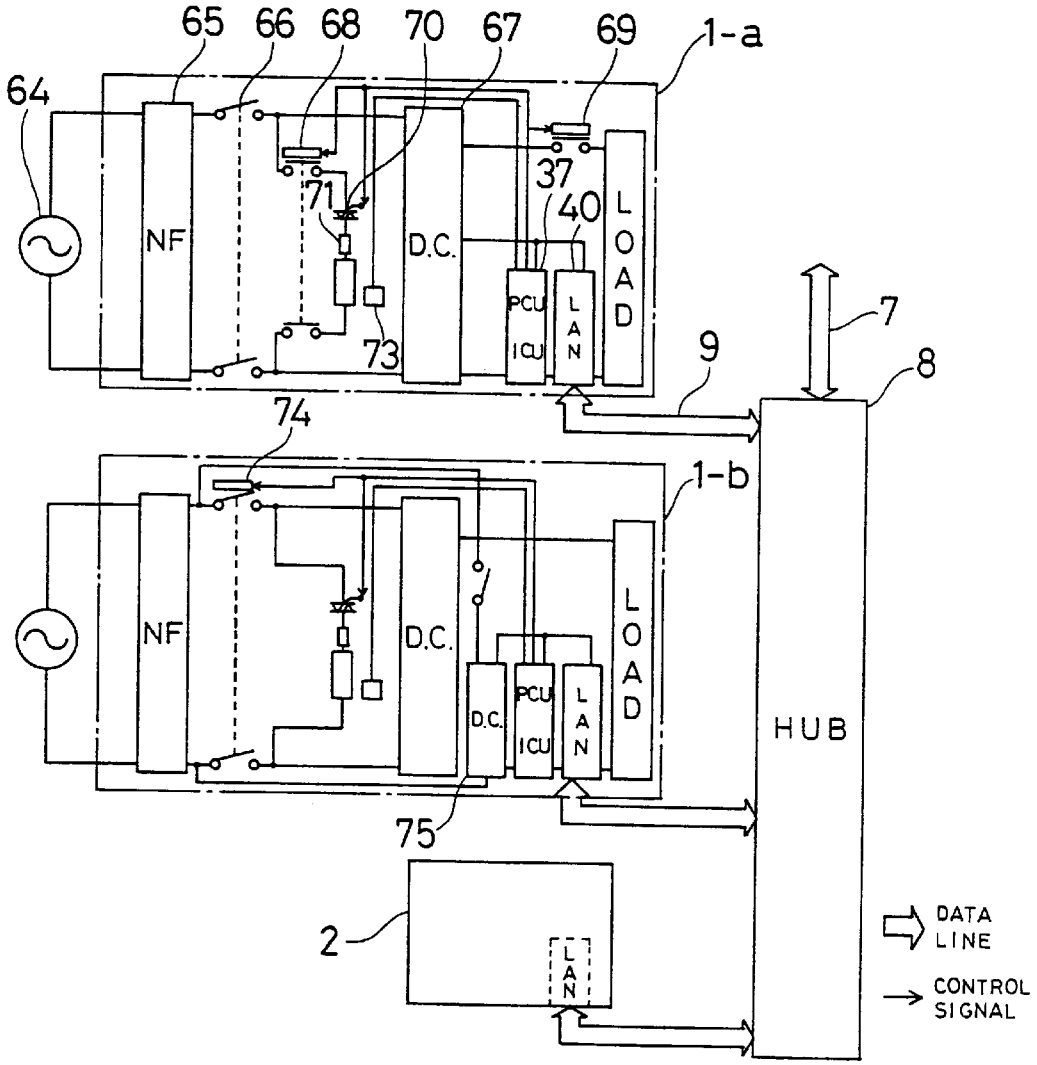
FIG. 10 is a circuit diagram for a digital image producing apparatuses (copiers) in accordance with one embodiment of the present invention.

FIG. 10 is a connection diagram of electric circuitry of the networked copiers of the present invention. This connection diagram corresponds to FIG. 4 and proves a detailed view of the circuitry where the 10Base-5 and 10Base-T are used. More particularly, the connection diagram illustrates the communication of a plurality of copiers with a controller (a PC) and the power-on of power.

Supply of power according to the present invention is now explained. Taking the digital copier 1-*a* for example, in a state where a power switch 66 is on, power is normally supplied from an AC power source 64 obtained from a wall outlet, a switch board or the like of a building. The power passes through a noise filter (NF) 65 for absorbing noise and the power switch 66, and reaches to a DC power source 67 which supplies power for performing various controls. DC voltage generated by the DC power source 67 is supplied to a LAN card 40*a* for communication and supplied to the image processing section 34 and the CPU 37 in an amount necessary for communication and various kinds of controls described later.

As regards other loads at this time, a relay (PR2) 69 is off so that power consumption during standby can be reduced. A heater lump 72 is connected to the power switch 66 via a thermal cutout 71, a TRIAC (triode AC semiconductor switch) 70 and a relay (PR1) 68. The TRIAC 70 controls ON/OFF of the heater lump and its control terminal is connected to the CPU 37 by a photo-TRIAC coupler not shown.

The thermal cutout 71 turns off the heater lump with fusing a wire in the thermal cutout 71 in order to prevent the apparatus from burning even if a runaway or malfunction of the CPU may keep the heater lump on. The same effect can be obtained by a thermostat in place of the thermal cutout.

In the fixer 29, there is provided a thermistor 73 for keeping the temperature of the surface of a heat roller, not shown, heated by the heater lump 72 at the most suitable temperature for fixation of a toner. Output of the thermistor 73 is connected to the CPU 37. The thermister utilizes the characteristic that resistance changes linearly with temperature change. The temperature of the heat roller can be determined by converting the resistance to voltage and reading the converted value. The temperature of the heat roller is kept constant at a predetermined temperature by controlling the on/off of the TRIAC 70.

The LAN card 40 is connected to the HUB 8 via the cable 9 of the 10Base-T. The HUB 8 is connected to other copier 1-*b* and the controller (PC) 2. This form of communication is called a LAN, which is used in network systems of PCs or the like. Accordingly, more detailed explanation about the LAN is omitted.

Via the LAN, the PC 2 is capable of communicating with the digital copier 1-*a* and 1-*b* to turn on the relays 68 and 69 so that the copiers become ready for copying operation and various controls on the copy modes, printing conditions and the like. In reverse, the digital copiers 1-*a* and 1-*b* are capable of sending a signal representing that copy is possible and various information such as the content of the document to the PC 2.

The digital copier 1-*b* is somewhat different from the digital copier 1-*a* in how to power on. In the digital copier 1-*b,* a small-sized coil is provided within a power switch 74 instead of the relays 68 and 69. When the coil becomes on, the power switch 74 becomes on and the copier 1-*b* becomes ready to copy.

The power switch 74 is connected to a CPU 37. The CPU 37 and the LAN card 40 are supplied with power from a small-sized DC power source 75 instead of the usual DC power source. The DC power source 75 is located upstream to the power switch 74. Therefore, when the power switch 74 is off, the CPU 37 and LAN card 40 can be supplied with power.

In FIG. 10, the copiers of different types are connected, but the same copiers may be connected. In the same manner, it is possible to increase the number of copiers and to place a number of copiers of different kinds in a network system.

Figure 11:
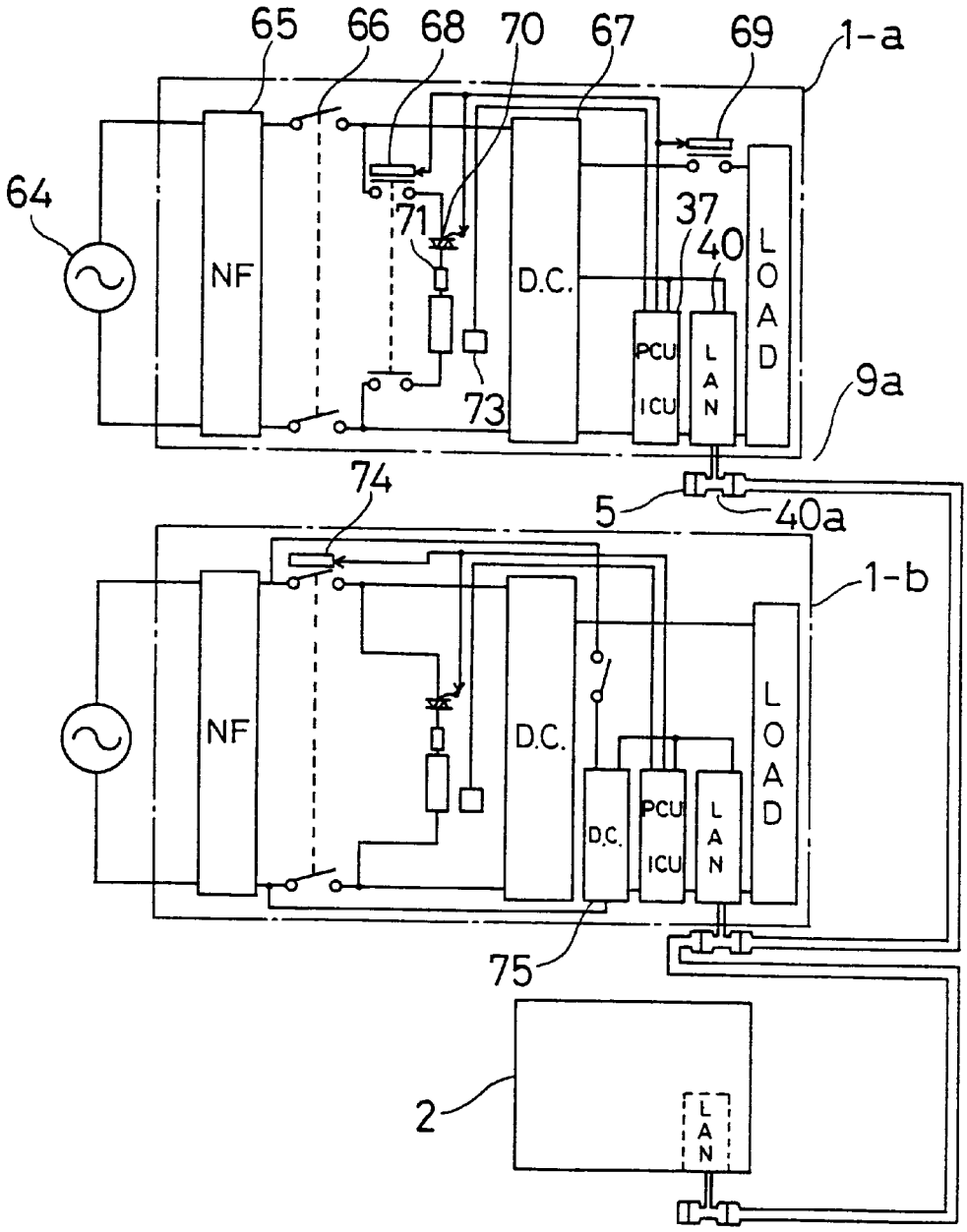
FIG. 11 is a circuit diagram for a digital image producing apparatuses (copiers) in accordance with one embodiment of the present invention.

FIG. 11 is a connection diagram of electric circuitry of the networked copiers of the present invention. This connection corresponds to FIG. 2, providing a detailed view of the circuitry where the 10Base-2 is used. The coaxial cable 9*a* is connected to the connector 40*a* extending in the shape of T from the LAN card 40. Other copier 1-*b* and the controller (PC) 2 are also connected. The terminating resistances 5 are connected to both ends of the connection.

Figure 12:
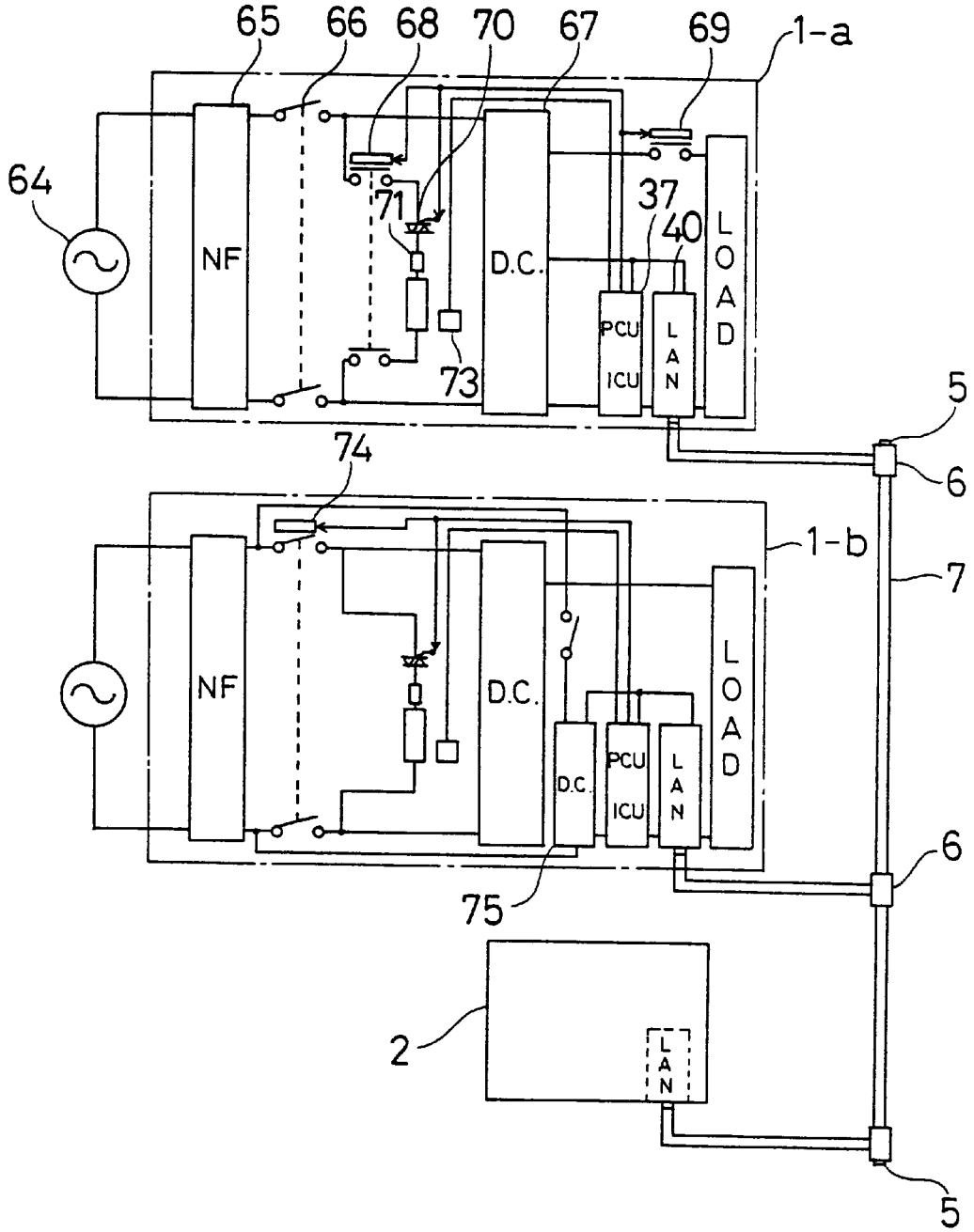
FIG. 12 is a circuit diagram in a digital image producing apparatuses (copiers) in accordance with one embodiment of the present invention.

FIG. 12 is a connection diagram of electric circuitry of the networked copiers of the present invention. This connection corresponds to FIG. 3, providing a detailed view of the circuitry where the 10Base-5 is used. The LAN card 40 is connected with the transceiver 6 via a cable. The transceiver 6 is connected to another transceiver 6 by the cable of 10Base-5 (a yellow cable) 7. The terminating resistances 5 are connected to both ends of the connection.

Figure 13:
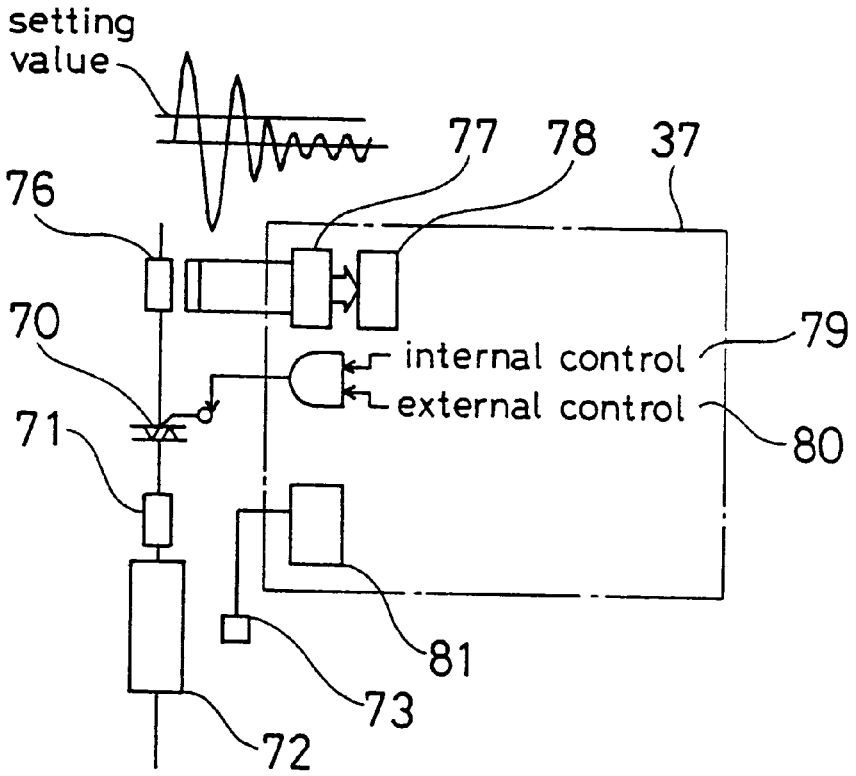
FIG. 13 illustrates control of a heater lump of a digital image producing apparatus (copier) in accordance with one embodiment of the present invention.

FIG. 13 is a detailed diagram illustrating the control of the heater lump. A current transformer 76 is placed in series with the heater lump 72, the thermal cutout 71 and the TRIAC 70. In the current transformer, a current flows in a coil on an output side in proportion to a current flowing on an input side. The current transformer is mainly used for detecting current on the primary side. An output section of the current transformer 76 is connected to the CPU 37. The current is converted to voltage in a voltage transform section 77, an analog value is divided into 256 and taken into the CPU. A halogen lump is mainly used for the heater lump 72. However, the halogen lump involves a rush current about ten times as high as normal current when the heater lump is turned on.

By using this current detection circuit, when the rush current stabilizes with respect to a predetermined constant current, a peak current end signal is sent to the PC 2 so that another copier is started up. Then, an on-signal (gate) of the TRIAC 76 is divided into a signal 79 for internal control and a signal 80 for external control.

Since the external control signal usually becomes on when the power becomes on, the internal control signal 79 repeats ONs/OFFs so that the heat roller maintains the predetermined temperature as in ordinary copiers. However, only when the inner heater lump is off in response to a notice signal from other copier described later, the external control signal 80 is off for several seconds, during which the heater lump 72 does not illuminate regardless of the internal control signal 79. These several seconds are a time period from the turning-on of the heater lump to the stabilizing of the peak current and not long enough to cool the heater lump.

The thermistor 73, as described above, changes its resistance value depending on the surface temperature of the heat roller. The resistance value is voltage- converted and A/D converted, and taken into the CPU 37.

The CPU has a table for voltage/temperature conversion and switches the TRIAC 70 to on/off so that the temperature of the heat roller becomes a predetermined temperature, for example, 200° C. Here, the CPU sends the notice signal to the PC 2 when it reaches a temperature a little lower than the predetermined temperature, e.g., 190° C. Thereby the PC 2 can judge in which copier the heater lump is about to illuminate.

Figure 14:
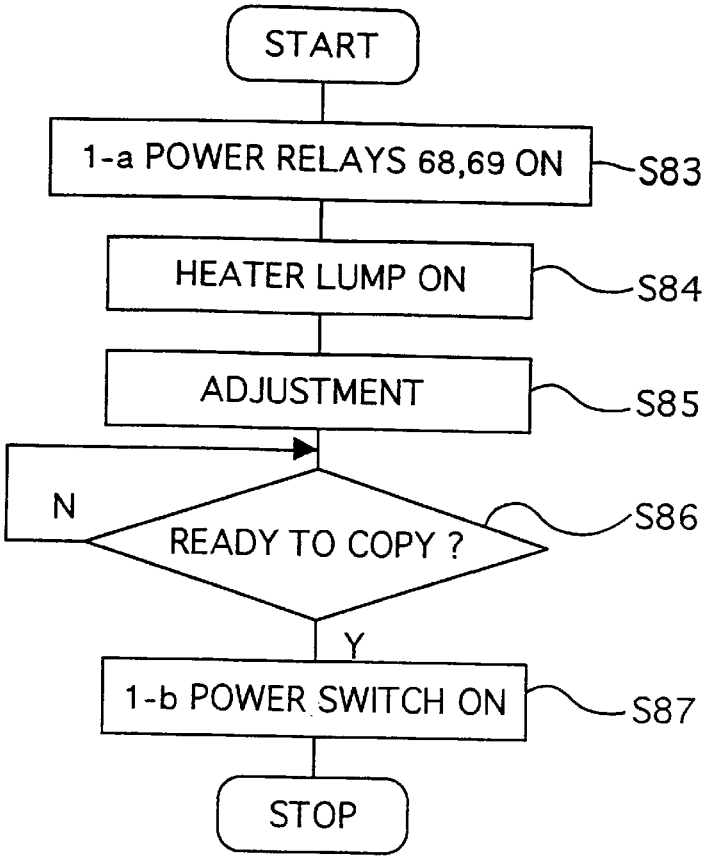
FIG. 14 is an operational flowchart in accordance with one embodiment of the present invention.

Next, referring to FIG. 14, a control method of the present invention is explained. First, in Step (referred to only as S for short hereafter) 83, the PC 2 or an operator starts up the first copier by turning on the power relays 68 and 69 of the digital copier 1-*a*. Then in S84, the digital copier turns the heater lump on to heat the fixer for starting warm-up. In S85, in order to keep image quality constant, a number of adjustments are performed including shading adjustment of the CCD, process control of the processor and preliminary revolution for uniform temperature of the heat roller. In S86, it is judged whether it is possible to make copies (that is, the copy is in a ready status) and if yes, a ready-to-copy signal is sent to the PC 2 in S87, and the PC, on the basis of the ready-to-copy signal, sends a power-on signal to turn the power switch 74 on. In the case of three or more copiers, the above steps are repeated.

Figure 15:
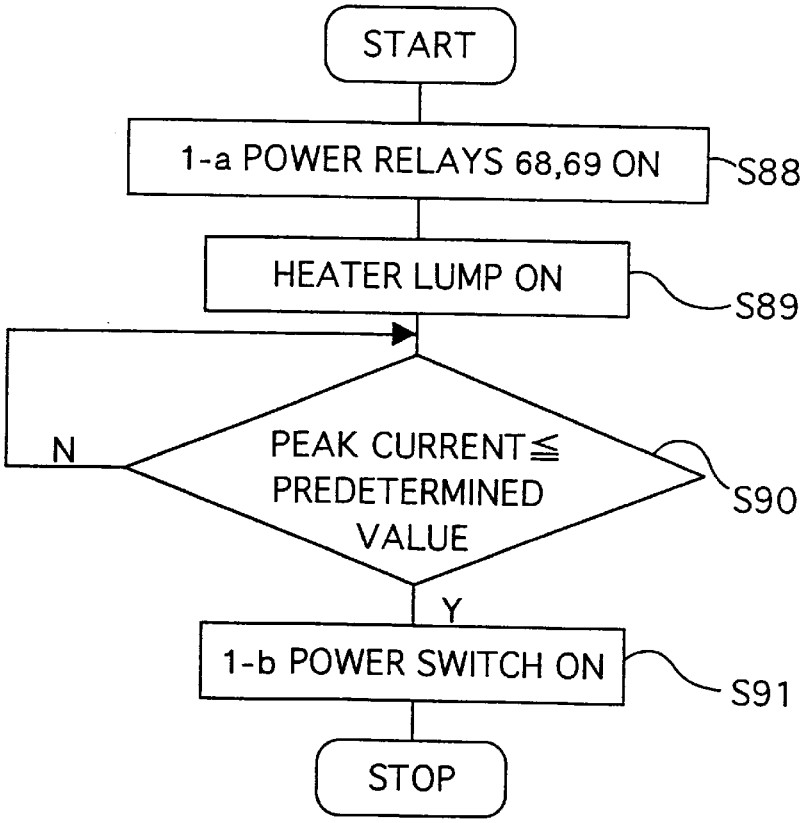
FIG. 15 is an operational flowchart in accordance with one embodiment of the present invention.

Further explanation is given referring to FIG. 15, which is a flowchart illustrating a control method for turning on the power supply of a second copier when the peak current immediately after the power-up of the first copier is not present. Steps which are the same as in FIG. 14 are omitted. First, in S88, the PC 2 or the operator starts up the first digital copier 1-*a*. Then in S 89, the heater lump is turned on and the warm-up is started. In S90, the peak current of the heater lump detected by the current transformer is watched until it calms down. After the peak current stabilizes, other copier 1-*b* is powered on in S91.

Figure 16:
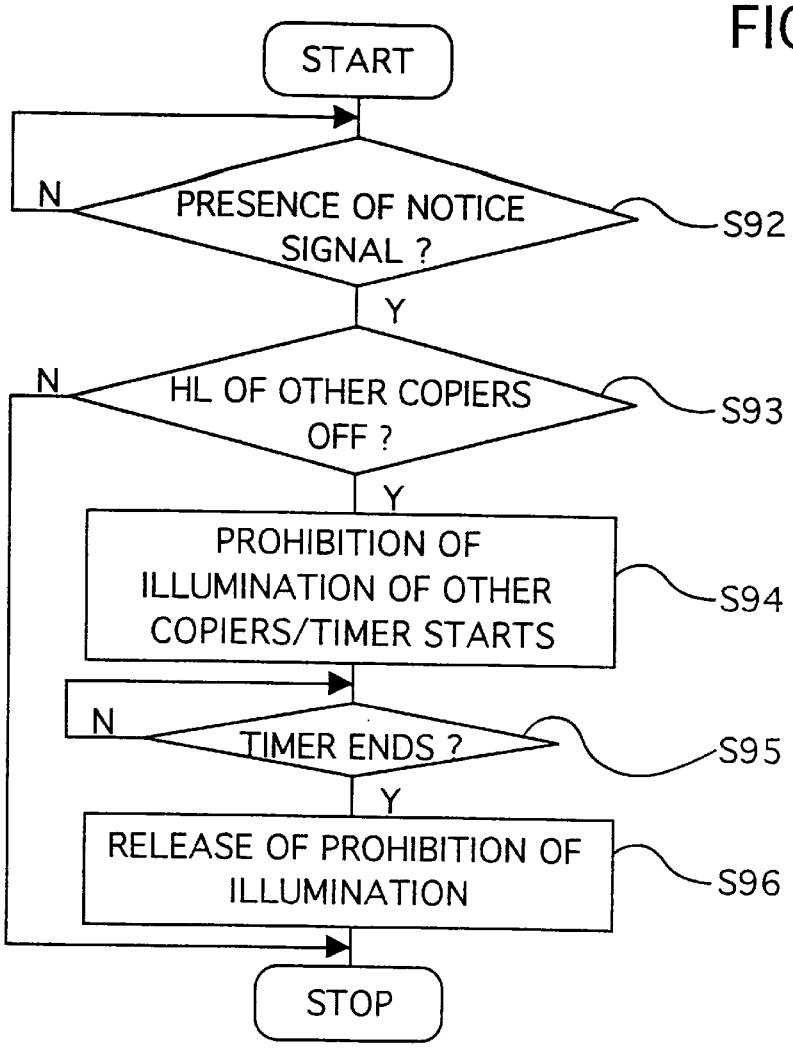
FIG. 16 is a operational flowchart in accordance with one embodiment of the present invention.

Explanation is given referring to FIG. 16, which is a flowchart illustrating a control method for prohibiting the illumination of the heater lump of another copier for several seconds while a plurality of copiers are in operation, for example, in the ready state or in coping operation.

First in S92, the PC 2 monitors the presence of the notice signal from the heater lumps of digital copiers which are controlled by the PC 2. For example, if the digital copier 1-*a* sends the notice signal, the PC 2 checks on or off of the heater lumps of other copiers in S93. In the case where the heater lumps of the other copiers are off, the process finishes and returns to a standby state.

In the case where the digital copier 1-*b* is off, a signal to prohibit the illumination of the heater lump is sent to the digital copier 1-*b* and a timer is started for counting a prohibition time in S94. After a predetermined time, e.g., several seconds, passes in S95, the prohibition signal is canceled in S96.

Figure 17:
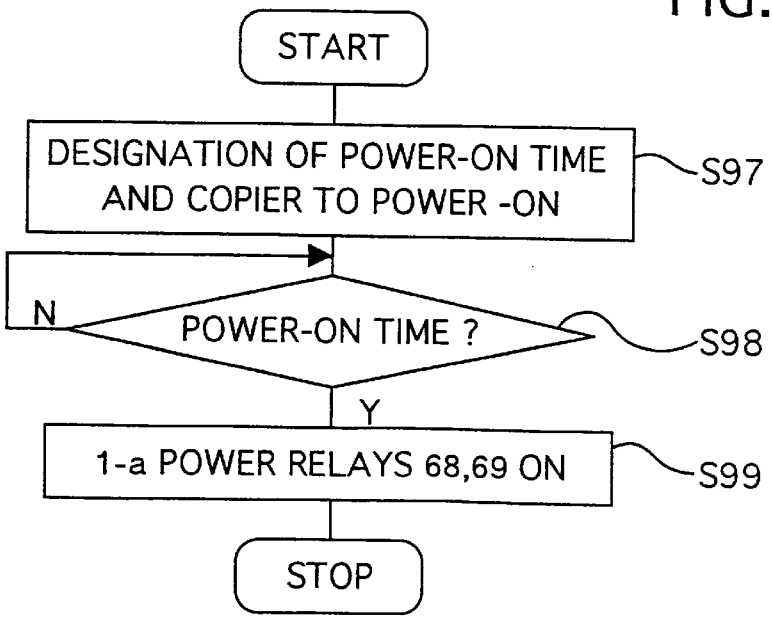
FIG. 17 is an operational flowchart in accordance with one embodiment of the present invention.

Explanation is now given referring to FIG. 17, which is a flowchart illustrating a control method for starting up the power supply of only one copier at a time designated by the operator.

First the operator or an administrator inputs a power-on time and a copier to be powered on to the PC 2. For example, the power-on time may be set to the starting hour of a company, when the digital copier 1-*a* is to be powered on. Then when it becomes the power-on time in S98, the PC turns the power relays 68 and 69 on to power on the designated digital copier 1-*a* in S99.

Figure 18:
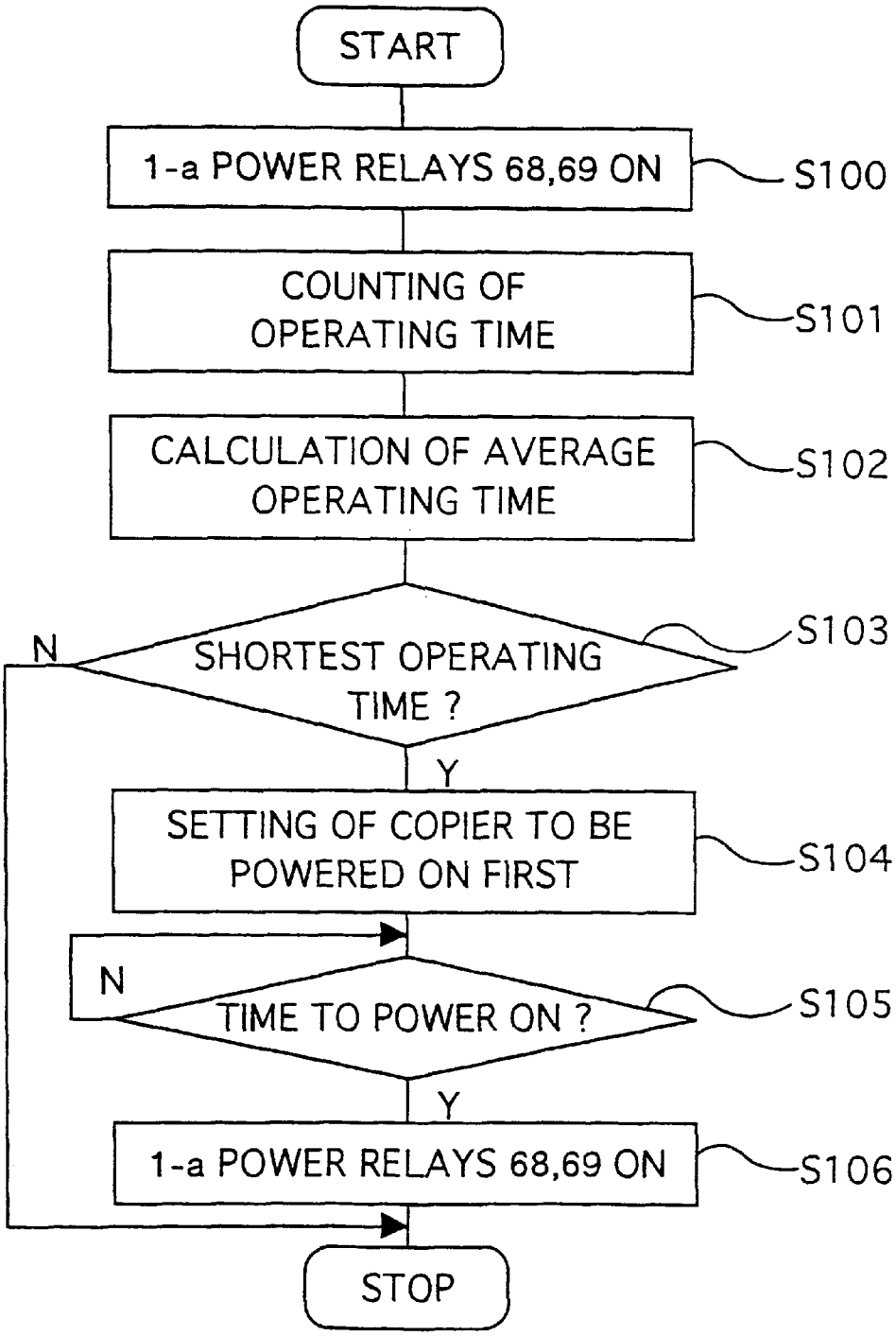
FIG. 18 is an operational flowchart in accordance with one embodiment of the present invention.

Explanation about control is now given referring to FIG. 18, which illustrates a control method for determining the first copier to be started up.

Here, the digital copier 1-*a* is used for explanation. In S100, the copier is started up and in S101 a coping time is counted. The coping time can be obtained by the PC by counting a time from a copy-start-key input signal to a ready-state return signal sent by the copier. Coping times can be accumulated for a day, a week, etc.

In S102, an average operating time is calculated. For example, it can be obtained by dividing the total of accumulated copying time by total operating days. In S103, the PC 2 judges which one of the copiers controlled thereby has the shortest operating time. If the digital copier 1-*a* is the least operated one, the 1-*a* is started up first on the next day in S106.

Figure 19:
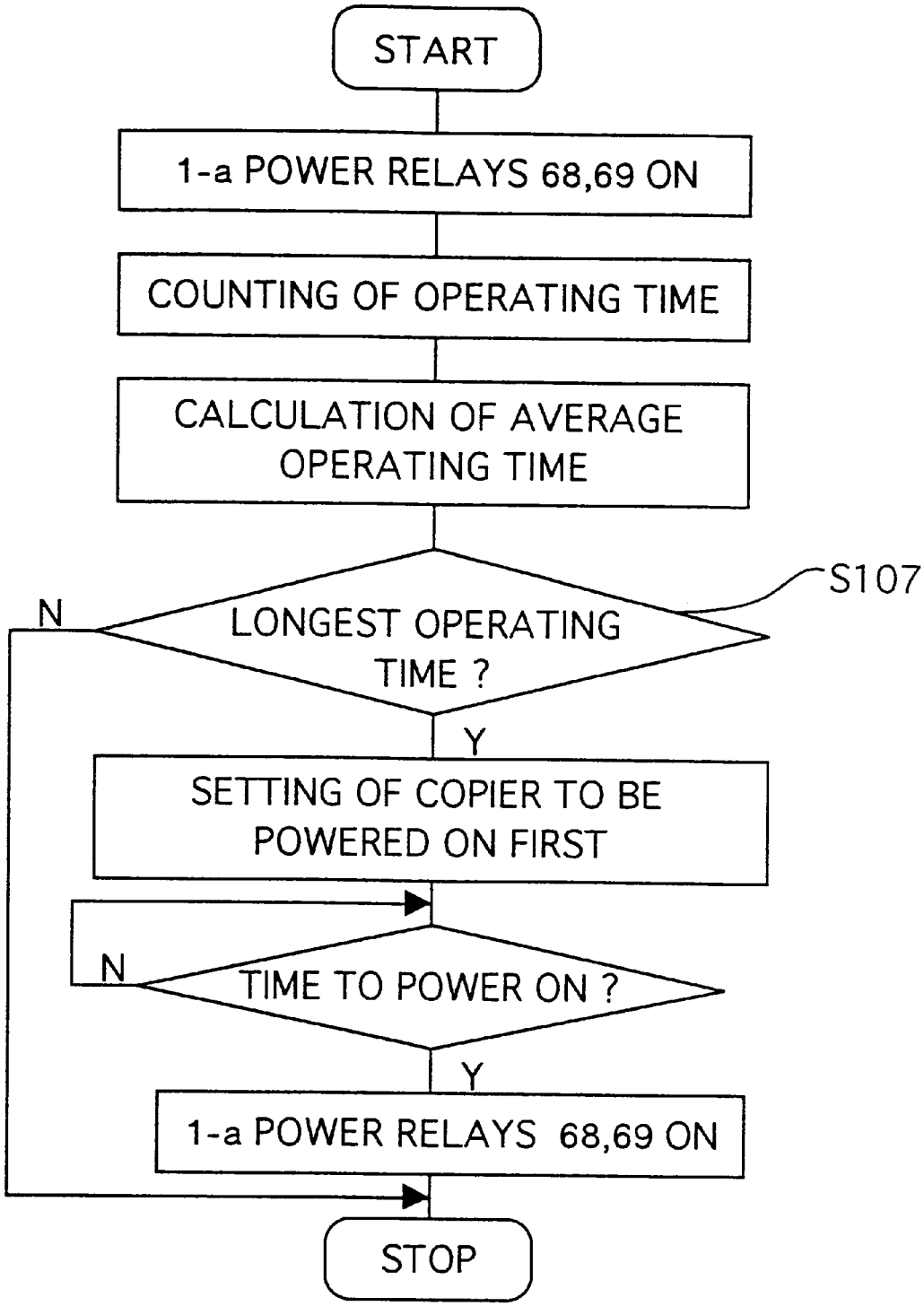
FIG. 19 is an operational flowchart in accordance with one embodiment of the present invention.

Another control is explained with reference to FIG. 19, which illustrates a control method for powering on the most used copier first. This control method is basically the same as the above-described method shown in FIG. 18. The only difference lies in that the most used digital copier is selected in S107 instead of the least used digital copier selected in S 106.

Figure 20:
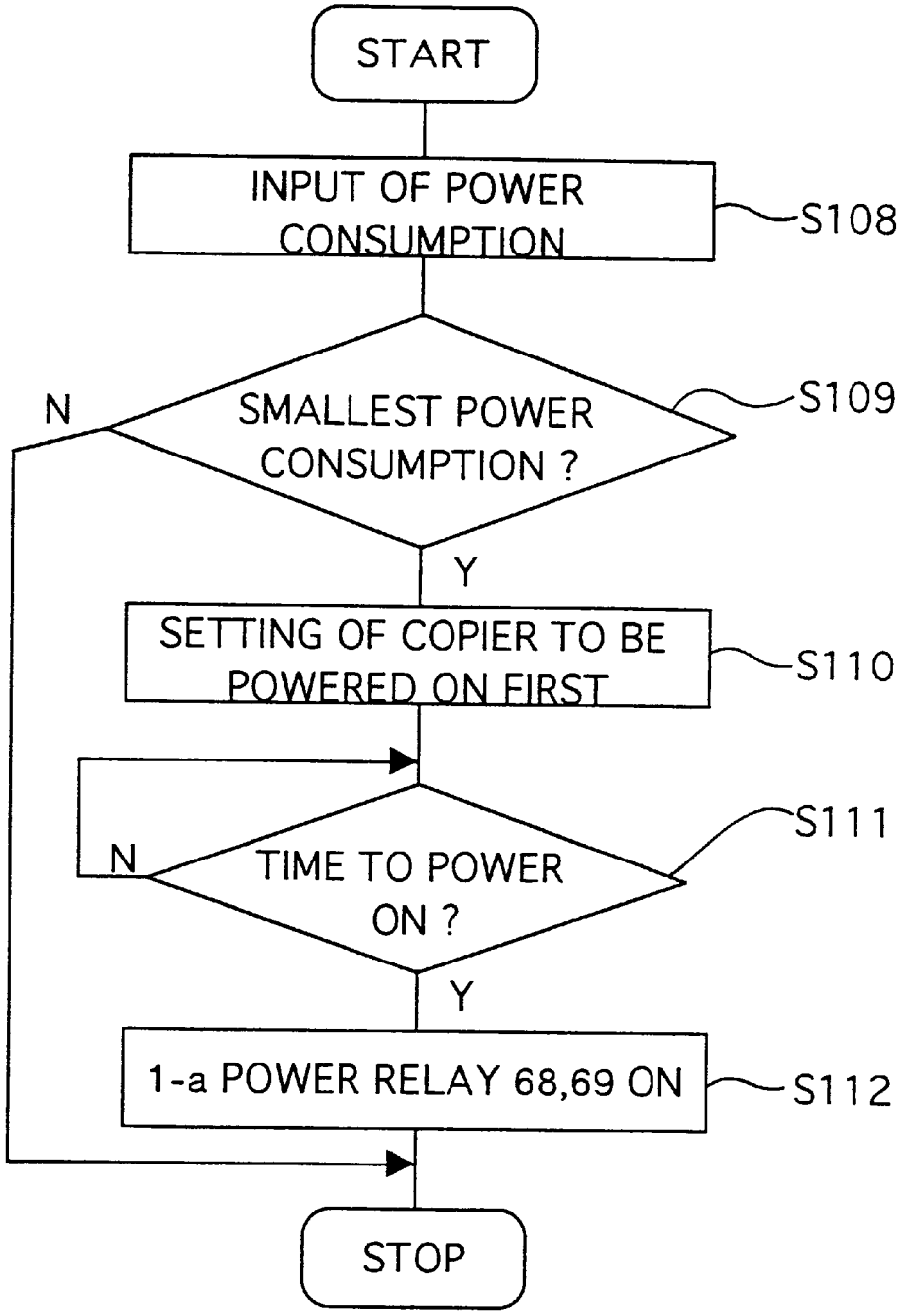
FIG. 20 is an operational flowchart in accordance with one embodiment of the present invention.

Another control is explained with reference to FIG. 20, which illustrates a control method for powering on first a copier whose power consumption is the smallest.

First in S108, the administrator inputs to the PC 2 the power consumptions of the copiers under control. Here, the power draws may be those written in catalogs of the copiers. Then, in S109, the PC 2 selects the one whose power consumption is the smallest of all the digital copiers under its control and designates it as the copier to be powered on first. For example, provided that the digital copier 1-*a* presents the smallest power draw, the digital copier 1-*a* is started up in S112 when it becomes the power-on time in S111.

Figure 21:
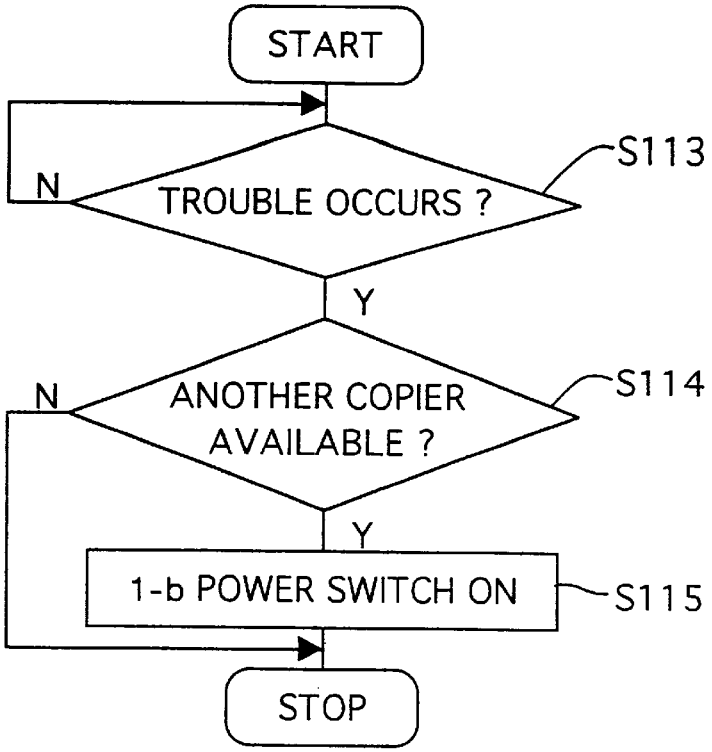
FIG. 21 is an operational flowchart in accordance with one embodiment of the present invention.

Another control is explained with reference to FIG. 21, which is a flowchart illustrating a coontrol method for, when a copier falls in trouble during operation, starting another copier.

For example, while the digital copier 1-*a* is in operation, the PC is ready for receiving a trouble signal in S113. If the trouble signal is received from the digital copier 1-*a,* the PC looks for a digital copier whose power supply is off in S114 and powers on the digital copier, e.g., the copier 1-*b,* in S115.

Another control is explained with reference to FIG. 22, which is a flowchart illustrating a control method for, when a copier falls in trouble during operation, starting another copier that is capable of making the same copy as the copier in trouble. The flow of control is almost the same as that shown in FIG. 21, but the PC looks for a copier capable of making copies in the same mode in S116.

The same mode is judged from copy modes available with each of the copiers inputted beforehand by the administrator and data on the sizes of paper cassettes sent by each of the copiers.

Another control is explained with reference to FIG. 23, which is a flowchart illustrating a control method for, if a copier capable of making copies in the same mode is found in the case of FIG. 22, setting the mode to the copier.

Figure 22:
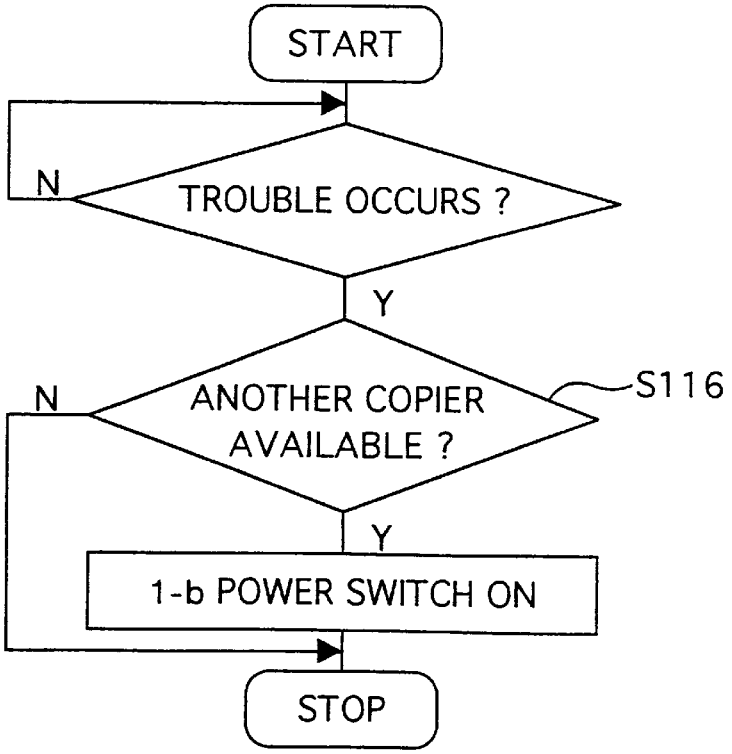
FIG. 22 is an operational flowchart in accordance with one embodiment of the present invention.
Figure 23:
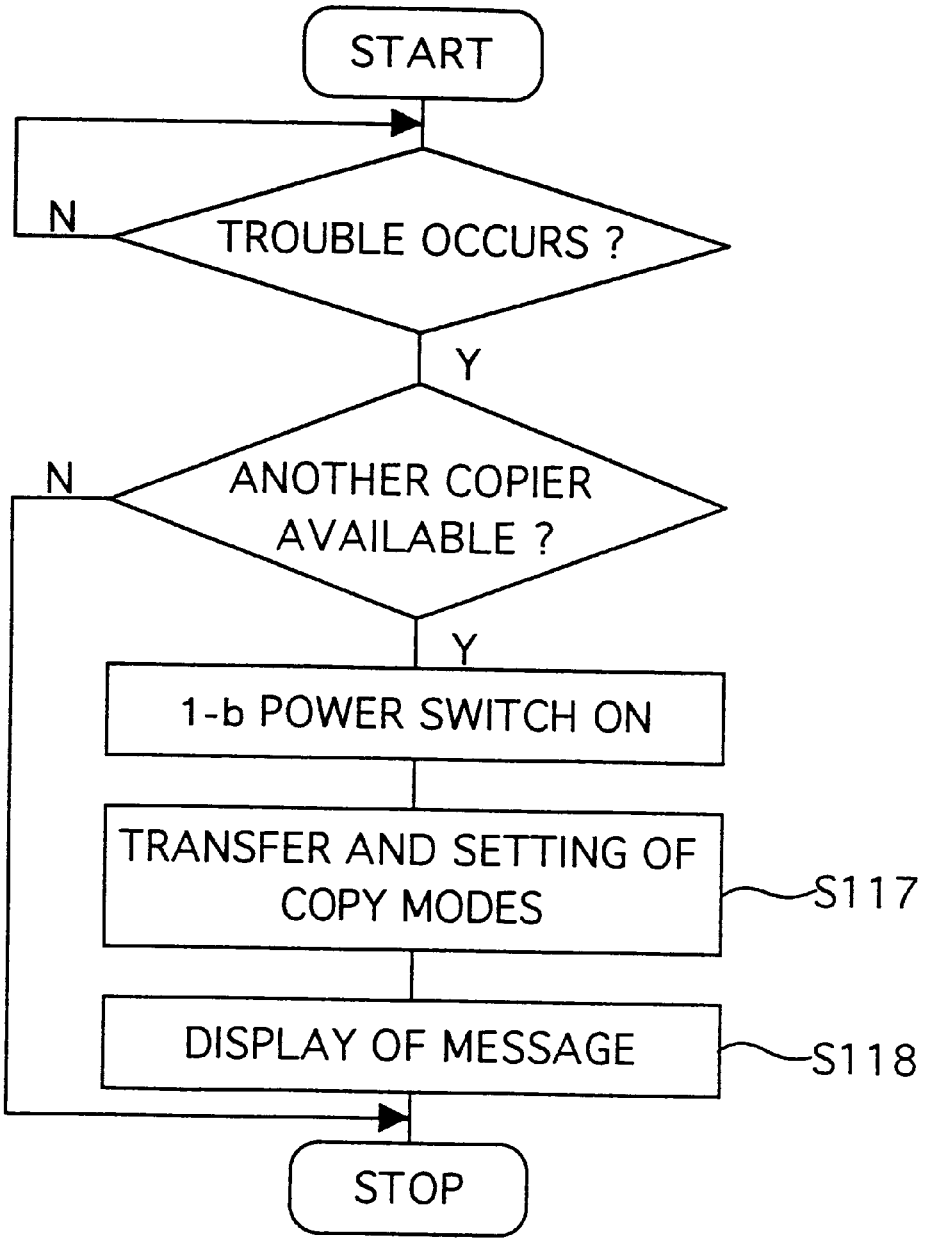
FIG. 23 is an operational flowchart in accordance with one embodiment of the present invention.

This flowchart is almost the same as that in FIG. 22, but the copy modes of the copier in trouble are sent and designated to the copier capable of copying in the same mode in S117. Then in S118, the name or the location of the substitute copier is displayed on the copier in trouble. Here, the copy modes include a density mode, a two-/single-sided copy mode, a sorting/non-sorting mode, the paper size and the like except the number of copies.

Figure 24:
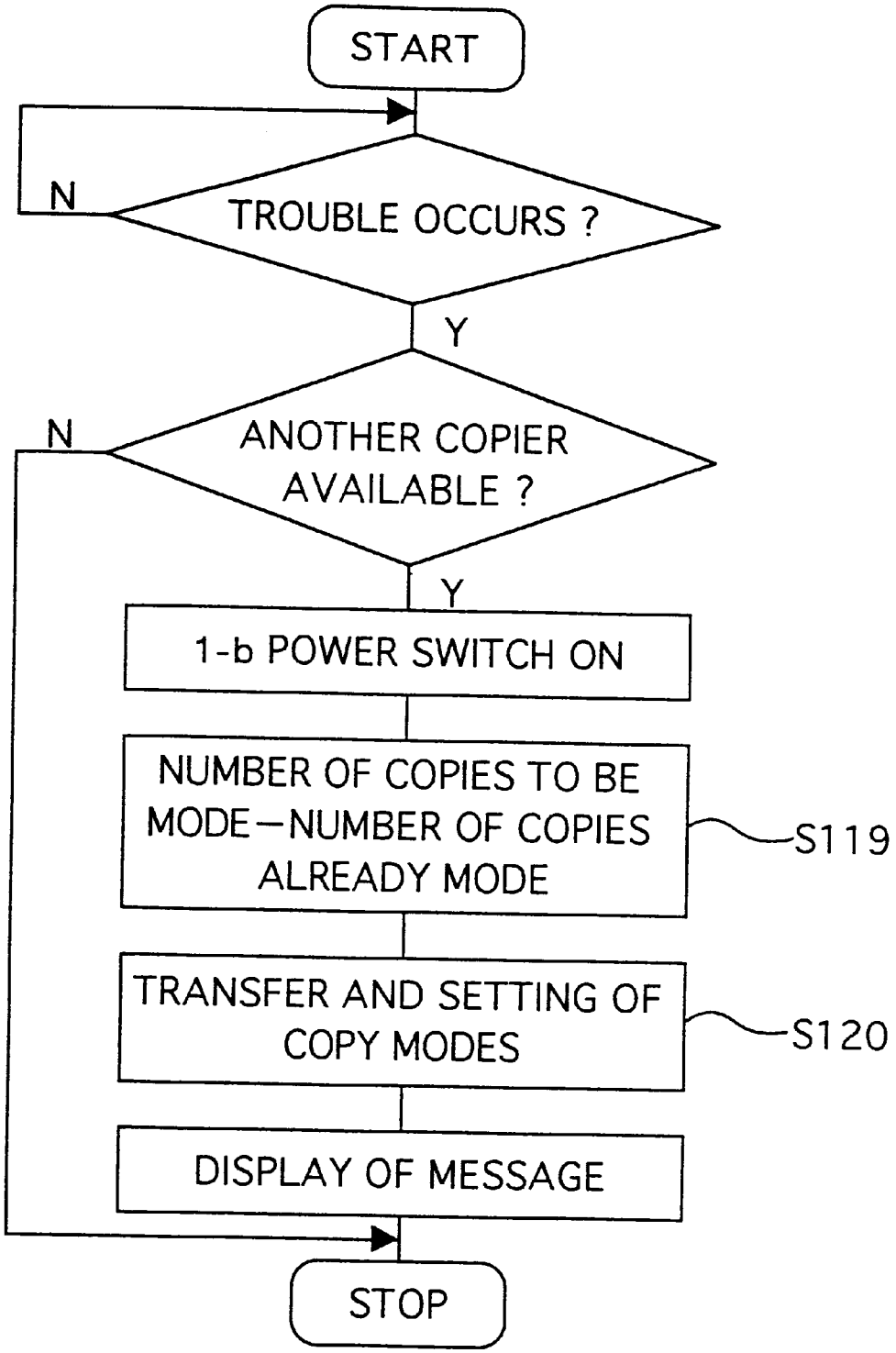
FIG. 24 is an operational flowchart in accordance with one embodiment of the present invention.

Another control method is explained with reference to FIG. 24. In this control, the number of copies is designated in addition to the copy modes in the case of FIG. 23. If a trouble occurs, the number of copies already made is subtracted from the originally set number of copies, in S119. In S120, the remaining number of copies to be made is designated to the substitute copier.

Another control is explained with reference to FIG. 25, which is a flowchart illustrating a control method for, after a copier is started up at the designated time (FIG. 17), starting up another copier on the basis of a copy start signal by the above copier. First, in S121, the digital copier 1-*a* is started up. Then, in S122, the copier 1-*a* is waiting for the staring of copying. When a first operator starts copying, another copier which is off is searched for in S123. If the digital copier 1-*b* is sought out here, for example, the copier 1-*b* is powered on in S124.

Another control is explained with reference to FIG. 26, which is a flowchart illustrating a control method for selecting a copier whose power consumption is the lowest as said another copier to be powered on in FIG. 25.

After the first copier is powered on, a copier whose power consumption is the lowest is selected in S125 to be powered on. Power consumptions here are inputted beforehand to the PC 2 by an administrator. The power consumptions may be values described in catalogs or the like of copiers.

Figure 27:
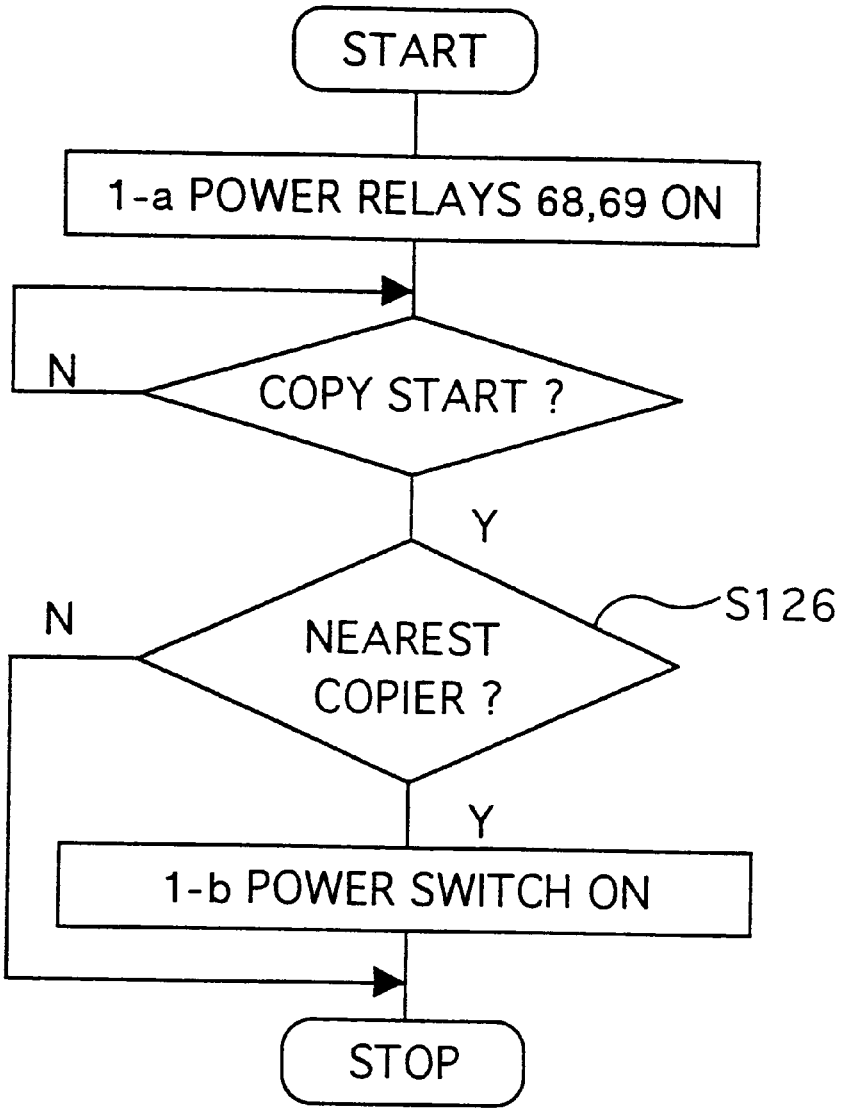
FIG. 27 is an operational flowchart in accordance with one embodiment of the present invention.

Another control is explained with reference to FIG. 27, which is a flow chart illustrating a control method for powering on a copier which is the nearest to the first copier when the first copier starts copying.

In this flowchart, when the copy start signal is detected after the first copier is started up, the nearest copier is powered on. The nearest copier here is selected depending on groups recorded beforehand in the PC 2 by the administrator. For example, where the digital copiers 1-*a* and 1-*b* are placed on the first floor and the digital copiers 1-*c* and 1-*d* are placed on the second floor, the digital copier 1-*b* is powered on in response to the copy start signal of the digital copier 1-*a*.

Figure 28:
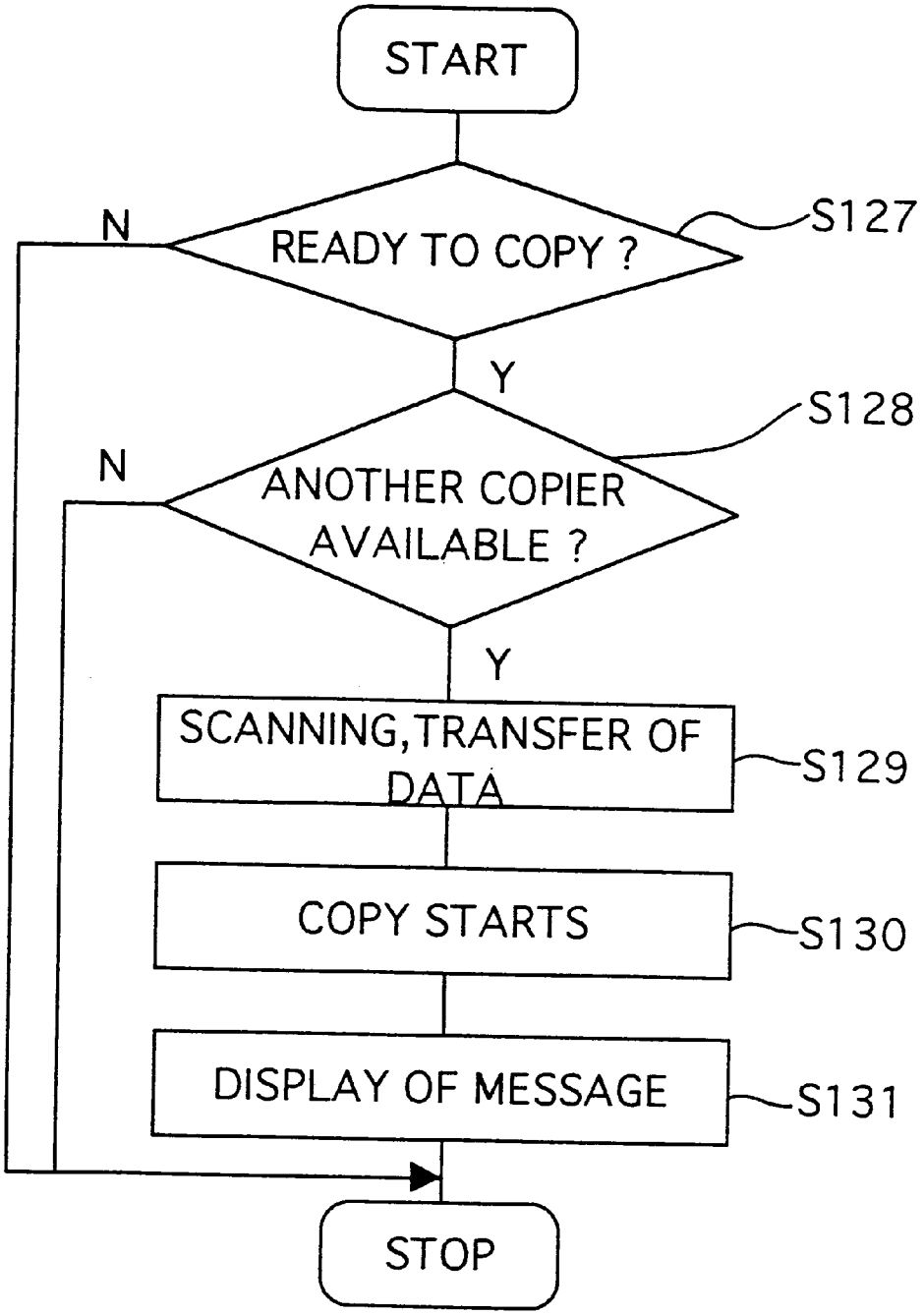
FIG. 28 is an operational flowchart in accordance with one embodiment of the present invention.

Another control is explained with reference to FIG. 28, which is a flowchart illustrating a control method for only scanning an original by a copier under warm-up and outputting results of scanning by another copier.

First, when the operator starts copying with a digital copier, the copier is judged as to whether the copier is ready to copy in S127. If the copier is under warm-up and not ready, another copier ready to copy is looked for in S128. In S129, scanning is performed by the copier under warm-up. Image data of an original and a copy mode set by the operator are sent to the copier ready to copy, which then produces output about the original in S130. Subsequently, the PC 2 displays the name and the location of the copier producing the output on a display of the copier under warm-up operated by the operator.

Figure 29:
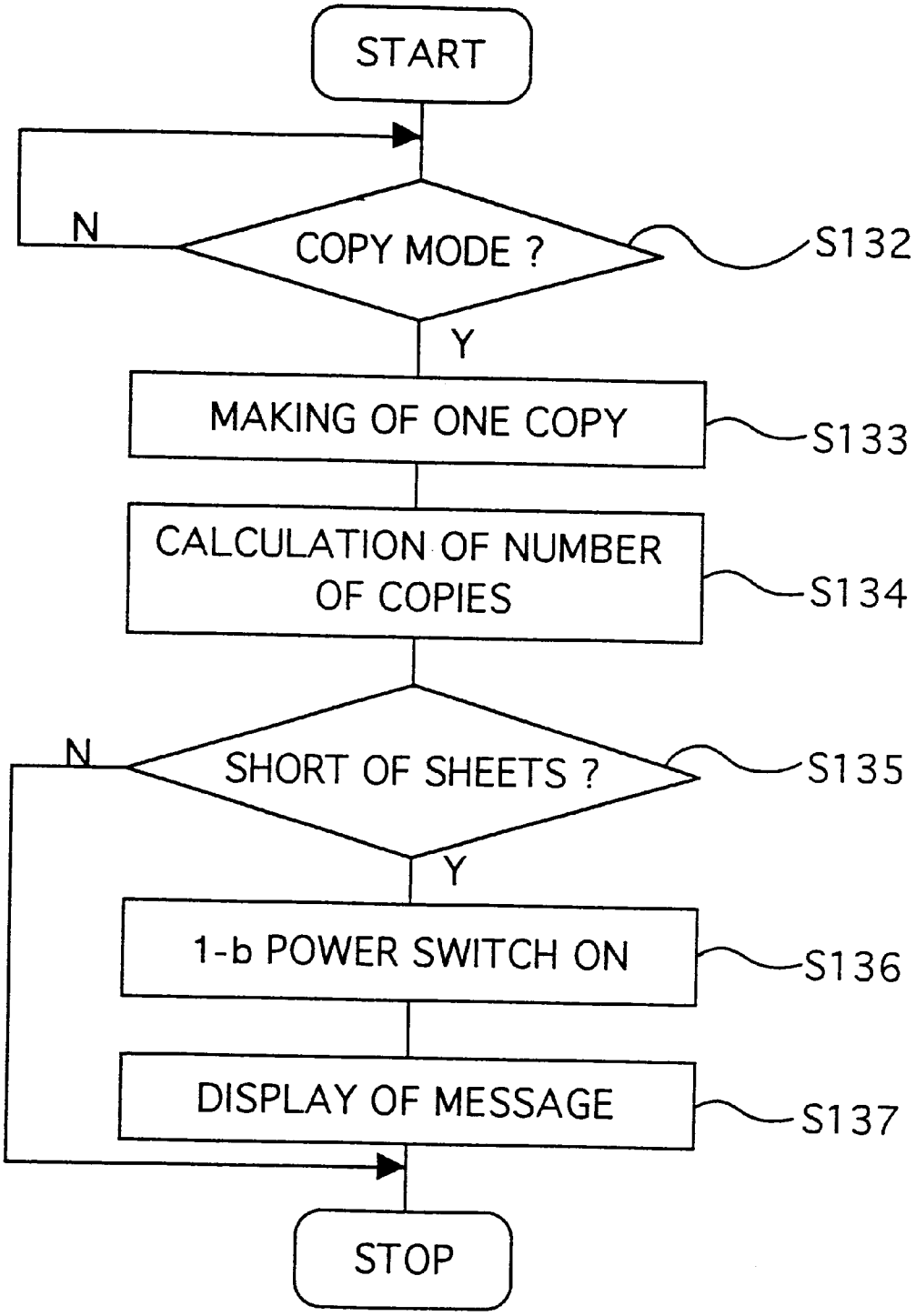
FIG. 29 is an operational flowchart in accordance with one embodiment of the present invention.

Another control is explained with reference to FIG. 29, which is a flowchart illustrating a control method for, if a copier operated by the operator is clearly short of a necessary number of sheets designated by the operator in FIG. 25, powering up another copier for compensation of the shortage.

First, in S132, the PC 2 acquires information about the copy mode set by the operator from the digital copier. Then, copying is started on the actuation of the copy start key by the operator. In S133, the number of sheets in a paper feeder is counted after one copy is produced by this copy mode. In S134, the number of necessary sheets is calculated from the number of sheets counted in S133 and the number of copies to be made.

If the remaining number of sheets in the paper feeder is insufficient in S135, another copier is powered on and the power-on of said another copier in S136 is displayed on the control panel of the copier operated by the operator. The remaining number of sheets in the paper feeder may be counted by a known method of calculating on the number of pulses generated by an encoder mounted to an elevator motor in the paper feeder.

Another control is explained with reference to FIG. 30, which is a flowchart illustrating a control method for, if the time necessary for copying in the copy mode designated by the operator is longer than the warm-up time of another copier in FIG. 25, powering on said another copier.

Figure 25:
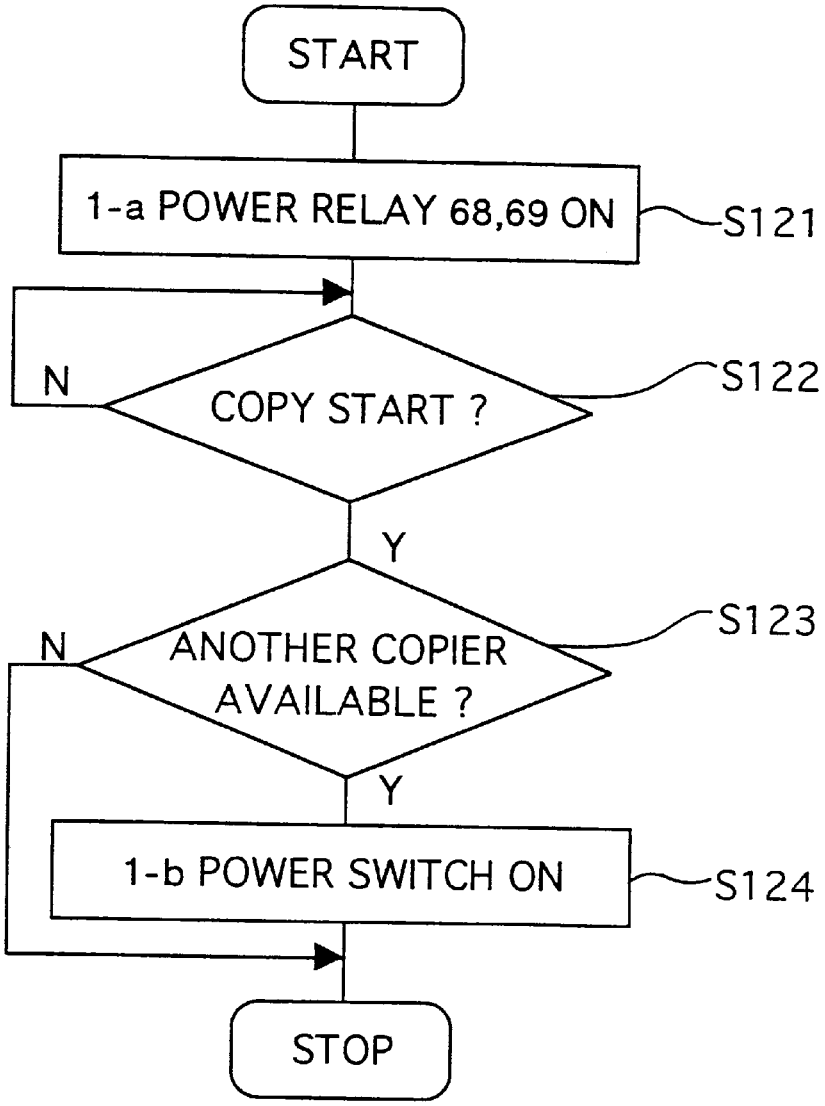
FIG. 25 is an operational flowchart in accordance with one embodiment of the present invention.
Figure 26:
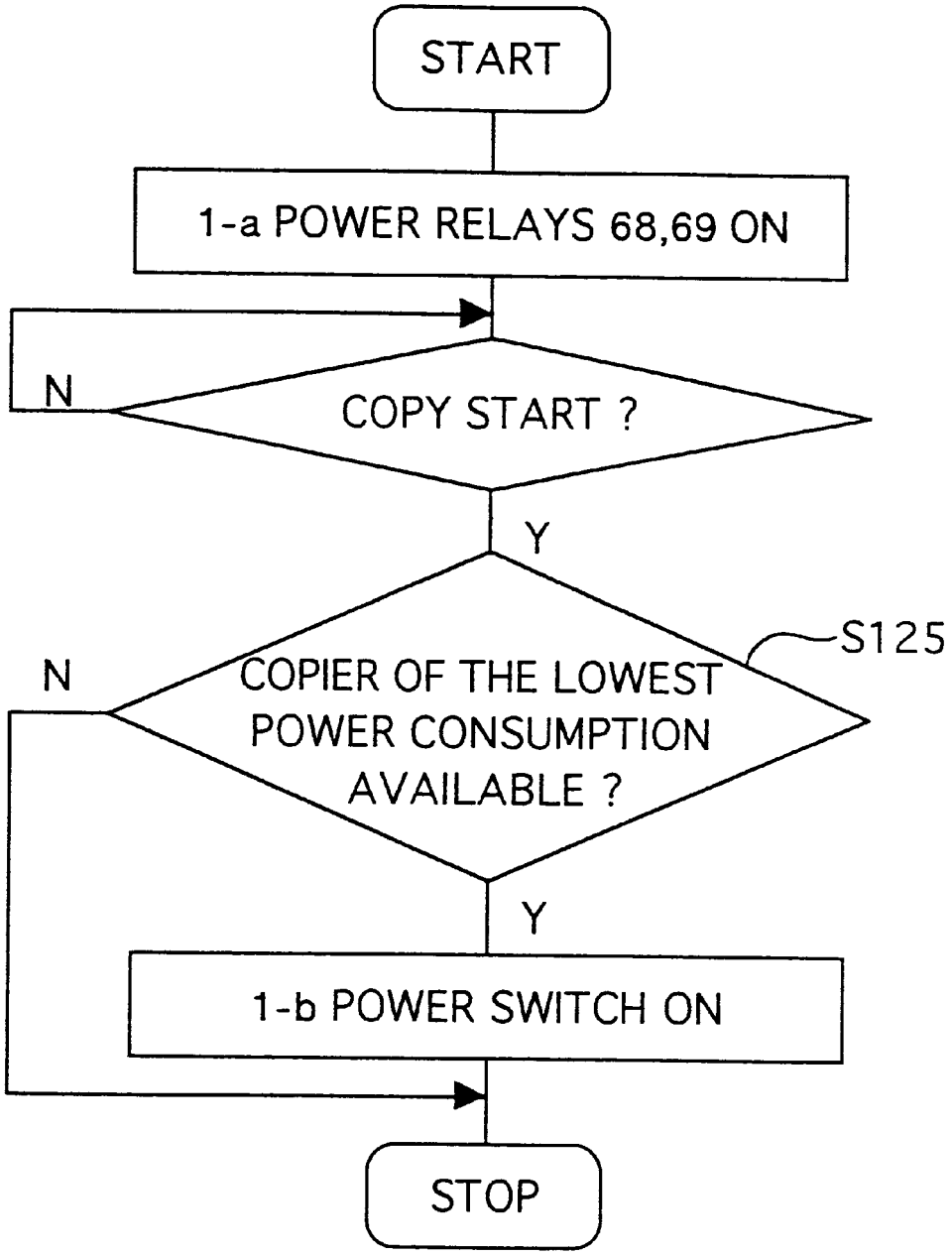
FIG. 26 is an operational flowchart in accordance with one embodiment of the present invention.

First, in S138, the copier in the case of FIG. 25 is powered on. Then, in S139, the PC 2 counts and records the warm-up time at this time. In S141, the necessary copying time is calculated from the copy mode and the number of copies set by the operator in S140.

If in S142 it is judged from the warm-up times stored beforehand that another copier can be warmed up in a time shorter than the necessary copying time, said another copier is started up in S143. As for the necessary copying time here, manufacturers' stated performance specifications of the copier are inputted beforehand to the PC 2 by the operator. For such a complicated copy mode as is not stated in a specification of a copier, another copier is powered on as the necessary copying time cannot be calculated.

Another control is explained with reference to FIG. 31, which is a flowchart illustrating a control method for, if a copier is judged to have a shorter warm-up time in FIG. 30, performing tandem copying by said copier.

Figure 30:
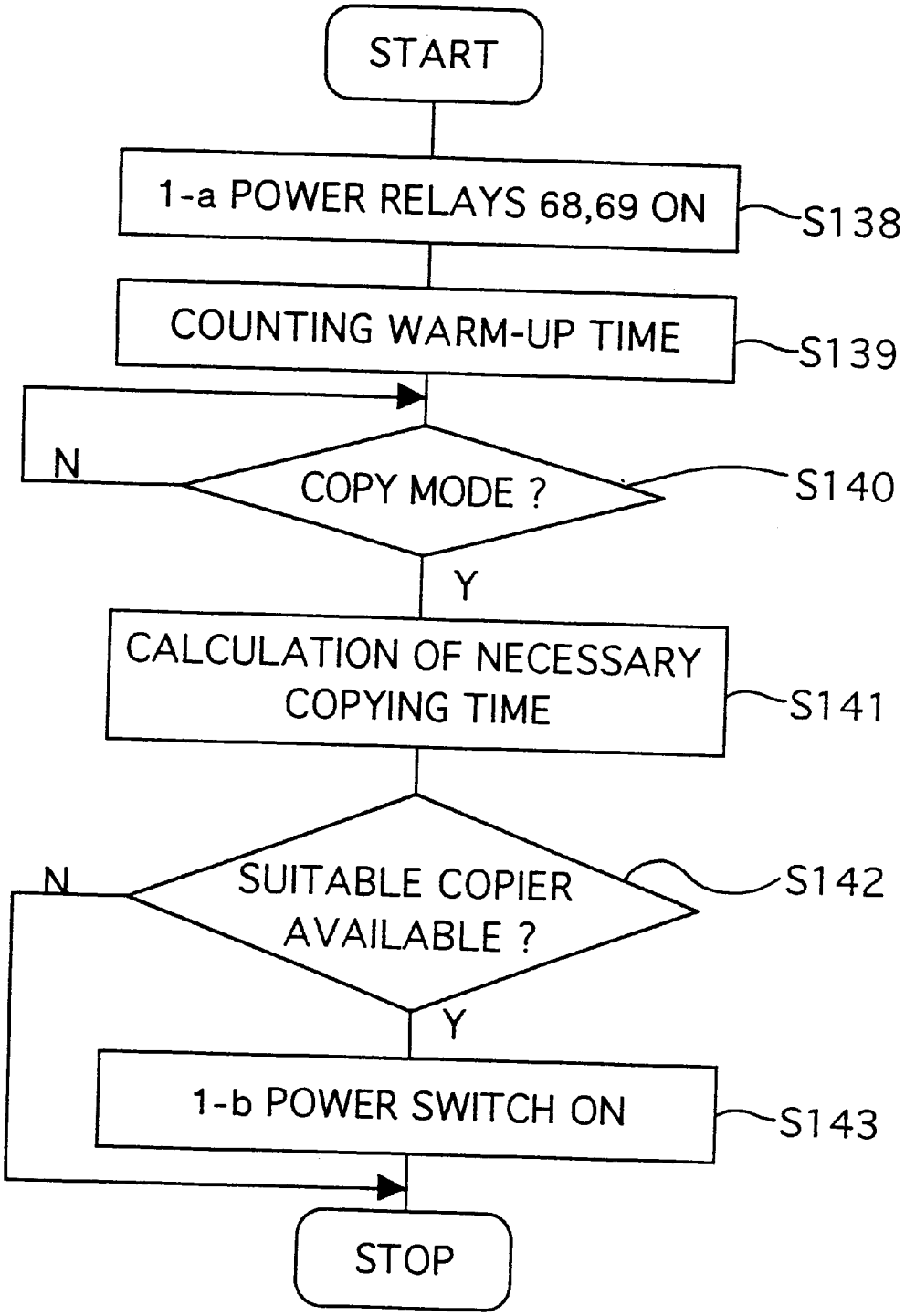
FIG. 30 is an operational flowchart in accordance with one embodiment of the present invention.
Figure 31:
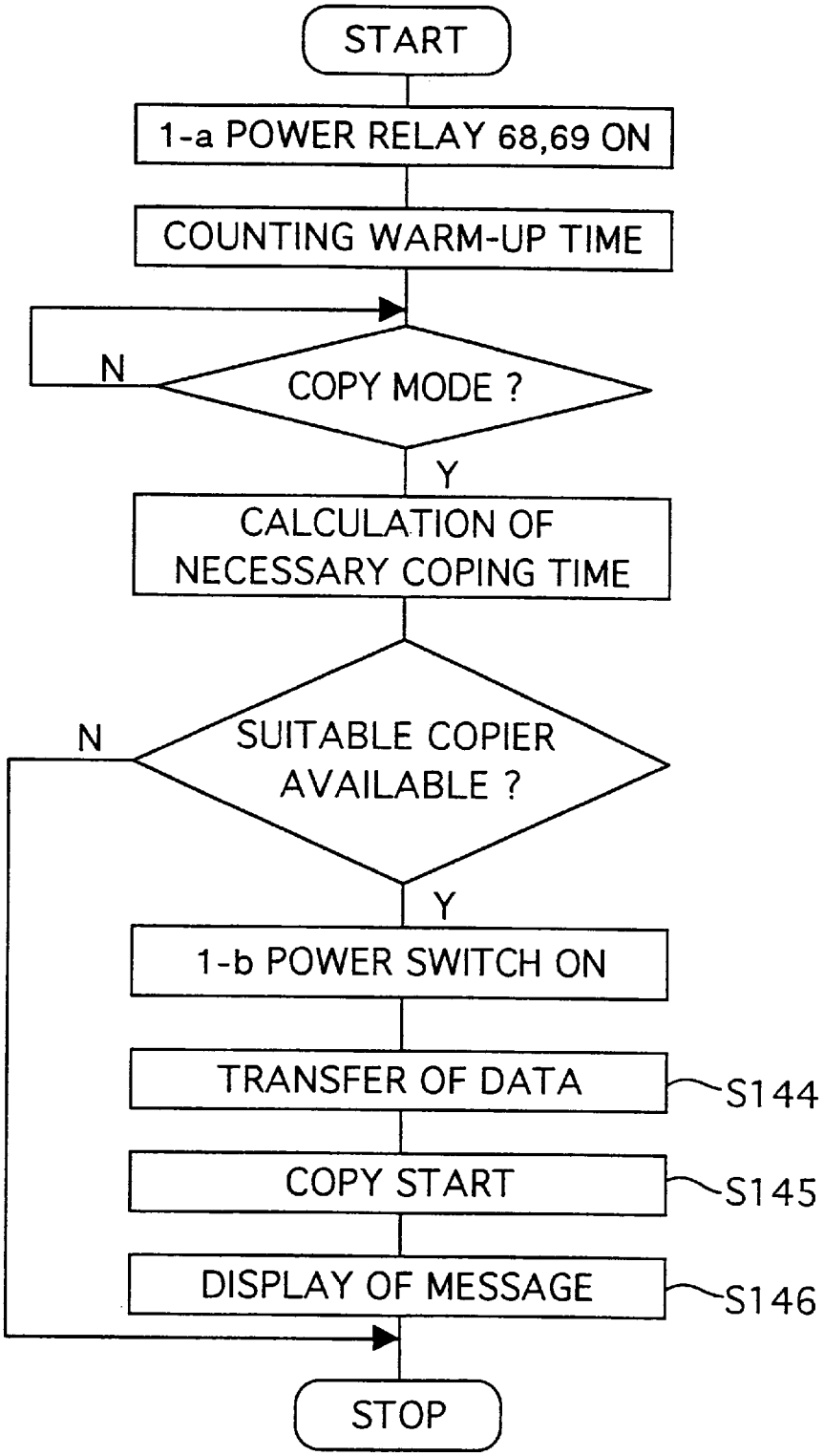
FIG. 31 is an operational flowchart in accordance with one embodiment of the present invention.

The process shown in this flowchart is the same as in FIG. 30 till another copier is powered on. However, in S144, the copy mode set by the operator and the image data of an original are sent to the powered-on copier. When the powered on copier becomes ready to copy, half of the rest of the number of copies set by the operator is copied by this powered-on copier in S145. This is displayed in the control panel of the copier used by the operator in S146.

Figure 32:
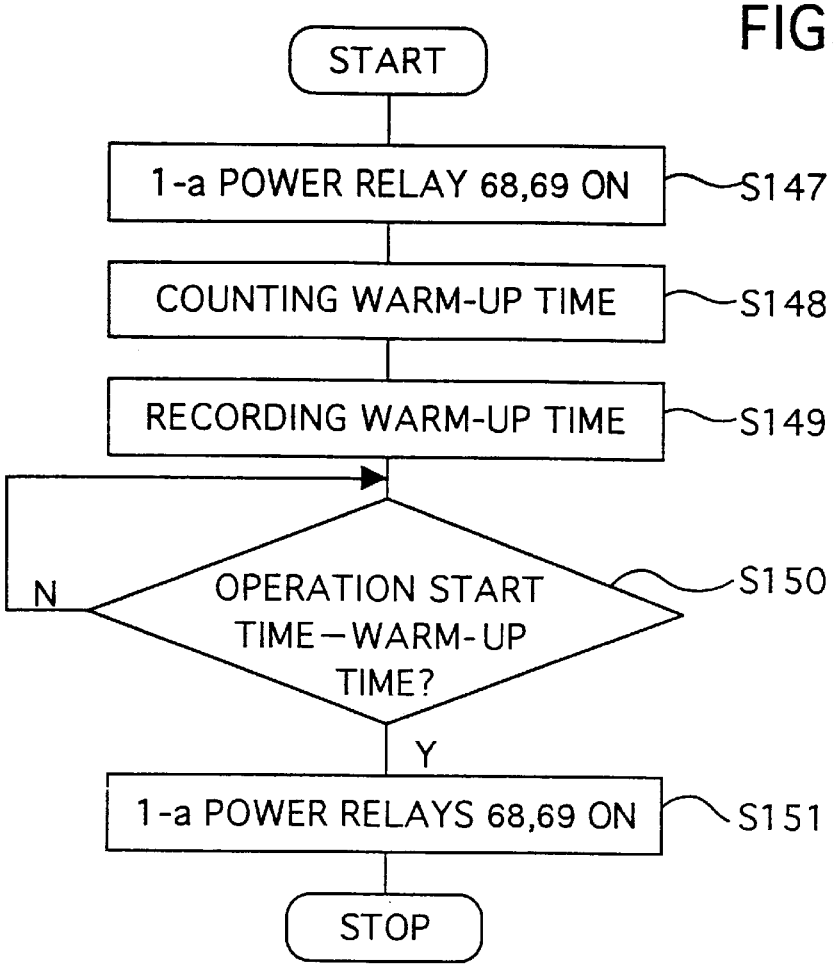
FIG. 32 is an operational flowchart in accordance with one embodiment of the present invention.

Another control is explained with reference to FIG. 32, which is a flowchart illustrating a control method such that, where a plurality of copiers are networked by the PC 2, the warm-up is completed simultaneously with all the copiers at a designated time.

First, in S148, the PC 2 counts and stores the warm-up time from the power-on of the copier in S147 to the time when the copier becomes ready to copy. Next day, when in S150 the PC 2 judges that it becomes time ahead of the designated operation start time by the warm-up time, the digital copier 1-*a* is powered on in S151 so that the digital copier 1-*a* can operate at the designated operation start time. If this control is conducted on plural copiers, the copiers are become ready to copy at the designated operation start time. In this case, he copiers are powered on in decreasing order of warm-up time.

Figure 33:
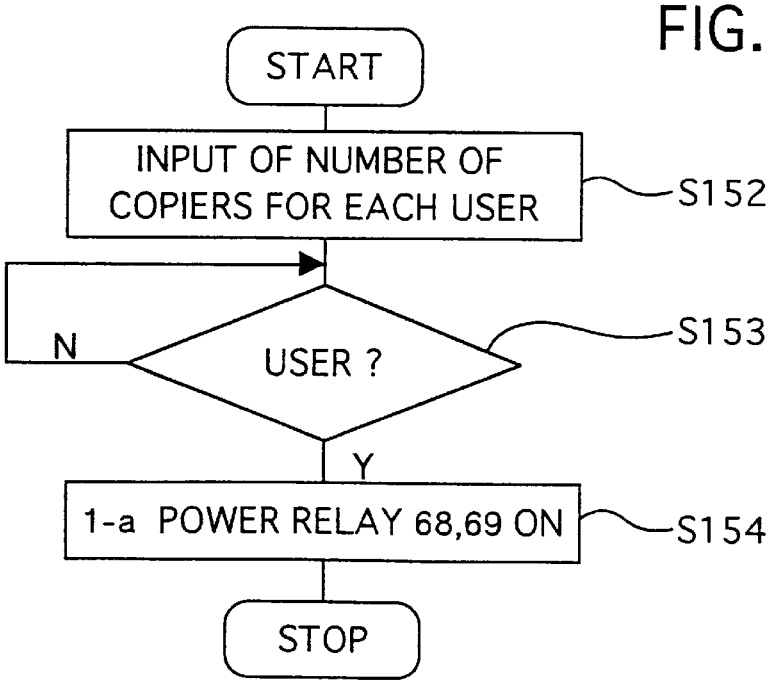
FIG. 33 is an operational flowchart in accordance with one embodiment of the present invention.

Another control is explained with reference to FIG. 33, which is a flowchart illustrating a control method for setting the kind and the number of usable copiers in correspondence to operators.

First, in S152, the administrator designates the kind and the number of usable copiers for every user, e.g., every employer, to the PC 2. Then, according to a user's identification in S153, for example, by inputting an account number or inserting an ID card of the user, copiers capable of being used by the user are powered on. For example, if an user A can use only the digital copier 1-*a,* the digital copier 1-*a* is started up in S154.

It will be obvious to those skilled in the art that the present invention is not limited to the above-described embodiments shown in the accompanying drawings and may be modified or changed without departing from the spirit or scope of the present invention.

What is claimed is:

1. A network system for copiers comprising:

a plurality of copiers each provided with communication means for communicating with external equipment and power-on means for powering on the copier in a hold state in response to an external signal received by the communication means; and a main controller including operation control means for controlling operation of the copiers and time setting means for setting time to power on a copier, the main controller being connected to the copiers by a network, wherein the operation control means executes control such that only predetermined one of the copiers is powered on at the power-on time set by the time setting means.

2. A network system according to claim 1, wherein each of the copiers is further provided with signal generating means for generating and sending out a copy-start signal representing that a copying operation starts and a copy-stop signal representing that the copying operation stops, the main controller further includes computation means for computing an average operating time per day for each of the copiers on the basis of the copy-start and copy-stop signals sent from each of the copiers, and the operation control means executes control such that one of the copiers whose average operating time is the shortest or the longest is powered on first.

3. A network system according to claim 1, wherein the main controller further includes a memory for storing power consumption of each of the copiers beforehand, and the operation control means executes control such that one of the copiers whose power consumption is the smallest is powered on.

4. A network system according to claim 1, wherein each of the copiers is further provided with signal generating means for generating and sending out a copy-start signal representing that a copying operation starts, and when the main controller receives the copy-start signal from one of the copiers, the operation control means executes control such that predetermined one of the copiers different from the copier having sent the copy-start signal is powered on.

5. A network system according to claim 4, wherein the main controller further includes a memory for storing a power consumption of each of the connected copiers beforehand, and the operation control means executes control such that the copiers are powered on in ascending order of the power consumptions stored in the memory .

6. A network system according to claim 4, wherein the main controller further includes a memory for storing beforehand a warm-up time for each of the copiers to become ready for copying, and the operation control means executes control such that the copiers are powered on in ascending order of the warm-up times stored in the memory.

7. A network system according to claim 4, wherein the main controller further includes a memory for storing a location of each of the copiers beforehand, and the operation control means executes control such that one of the copiers whose location is the nearest to the copier having sent the copy-start signal is powered on.

8. A network system according to claim 4, wherein each of the copiers is further provided with scanning means for only scanning a document while the copier is not ready for copying yet after being powered on, and the operation control means executes control such that an image obtained by scanning is transferred to one of the copiers which has sent the copy-start signal.

9. A network system according to claim 4, wherein the communication means of the copiers send information about a copy mode set by a user to the main controller, the main controller is further provided with a memory for storing a warm-up time for each of the copiers to become ready for copying after being powered on and prediction means for predicting, from the copy mode information sent by one of the copiers, a copying time of said copier, and the operation control means executes control such that other one of the copiers whose warm-up time is shorter than the predicted copying time is powered on.

10. A network system according to claim 4, wherein the copiers are further provided with input means for inputting user identifying information, the main controller further includes an information memory for storing beforehand the user identifying information in correspondence with the kind or the number of copiers that each user is able to use, the communication means of the copiers transfers the user identifying information inputted by the input means to the main controller, and the operation control means selects a copier to be powered on on the basis of the transferred user identifying information.

11. A network system for copiers comprising:

a plurality of copiers each provided with communication means for communicating with external equipment and power-on means for powering on the copier in a hold state in response to an external signal received by the communication means; and a main controller including an operation control means for controlling operation of the copiers, time setting means for setting a time to power on a copier and a memory for storing a warm-up time for each of the copiers to become ready for copying after being powered on, the main controller being connected to the copiers by a network, wherein the operation control means controls the order and time to power on the copiers so that all the copiers complete warm-up at the set power-on time.

12. A network system for copiers comprising:

a plurality of copiers each provided with communication means for communicating with external equipment, power-on means for powering on the copier in a hold state in response to an external signal received by the communication means and input means for inputting user identifying information; and a main controller including operation control means for controlling operation of the copiers and an information memory for storing beforehand the user identifying information in correspondence with the kind or the number of copiers that each user is able to use, the main controller being connected to the copiers via a network, wherein the communication means transfers the user identifying information inputted by the input means to the main controller, and the operation control means selects a copier to be powered on on the basis of the transferred user identifying information.

13. A network system according to claim 11, wherein the copiers are further provided with input means for inputting user identifying information, the main controller further includes an information memory for storing beforehand the user identifying information in correspondence with the kind or the number of copiers that each user is able to use, the communication means of the copiers transfers the user identifying information inputted by the input means to the main controller, and the operation control means selects a copier to be powered on on the basis of the transferred user identifying information.

* * * * *